US009300042B2

(12) United States Patent
Rogers et al.

(10) Patent No.: US 9,300,042 B2
(45) Date of Patent: Mar. 29, 2016

(54) MATCHING AND PATTERN CONTROL FOR DUAL BAND CONCENTRIC ANTENNA FEED

(71) Applicant: Honeywell International Inc., Morristown, NJ (US)

(72) Inventors: Shawn D. Rogers, Johns Creek, GA (US); Enrique J. Ruiz, Duluth, GA (US)

(73) Assignee: Honeywell International Inc., Morris Plains, NJ (US)

( * ) Notice: Subject to any disclaimer, the term of this patent is extended or adjusted under 35 U.S.C. 154(b) by 150 days.

(21) Appl. No.: 14/163,351

(22) Filed: Jan. 24, 2014

(65) Prior Publication Data

US 2015/0214616 A1 Jul. 30, 2015

(51) Int. Cl.

| | |
|---|---|
| ***H01Q 5/321*** | (2015.01) |
| ***H01Q 5/335*** | (2015.01) |
| ***H01Q 13/08*** | (2006.01) |
| ***H01Q 19/06*** | (2006.01) |
| ***H01P 1/161*** | (2006.01) |
| ***H01Q 13/02*** | (2006.01) |

(52) U.S. Cl.

CPC ..... *H01Q 5/321* (2015.01); *H01P 1/161* (2013.01); *H01Q 5/335* (2015.01); *H01Q 13/0258* (2013.01); *H01Q 13/08* (2013.01); *H01Q 19/062* (2013.01)

(58) Field of Classification Search

CPC ..... H01Q 5/321; H01Q 13/08; H01Q 19/062; H01Q 5/335

USPC ..... 343/795, 753

See application file for complete search history.

(56) References Cited

U.S. PATENT DOCUMENTS

| | | | |
|---|---|---|---|
| 3,234,551 | A | 2/1966 | Giger |
| 5,793,335 | A | 8/1998 | Anderson et al. |
| 6,031,434 | A | 2/2000 | Tatomir et al. |
| 6,720,932 | B1 | 4/2004 | Flynn et al. |
| 6,836,256 | B2 | 12/2004 | Hung |

(Continued)

FOREIGN PATENT DOCUMENTS

| | | |
|---|---|---|
| WO | 0041266 | 7/2000 |

OTHER PUBLICATIONS

European Patent Office, "Extended European Search Report from EP Application No. 14189453.5 mailed Jul. 8, 2015", "from foreign counterpart of U.S. Appl. No. 14/163,351", Jul. 8, 2015, pp. 1-7, Published in: EP.

(Continued)

*Primary Examiner* — Jean B Jeanglaude
(74) *Attorney, Agent, or Firm* — Fogg & Powers LLC

(57) ABSTRACT

A dual band concentric antenna feed is provided. The dual band concentric antenna feed includes an outer conductive tube and an inner conductive tube. The inner conductive tube is positioned inside the outer conductive tube and is coaxially aligned to a shared axis. A coaxial waveguide formed between the inner surface of the outer conductive tube and the outer surface of the inner conductive tube supports a first frequency band. A circular waveguide formed within of the inner conductive tube supports a second frequency band. The dual band concentric antenna feed also includes at least one transformer, a filter, and a plug in the coaxial waveguide. An impedance locus associated with the filter is high-frequency capacitive within the first frequency band and low-frequency inductive within the first frequency band. The plug is positioned near an aperture end of the concentric antenna feed.

20 Claims, 15 Drawing Sheets

(56) References Cited

U.S. PATENT DOCUMENTS

| | | | | |
|---|---|---|---|---|
| 6,839,038 | B2 * | 1/2005 | Weinstein | 343/795 |
| 8,013,687 | B2 | 9/2011 | Espino et al. | |
| 8,248,321 | B2 | 8/2012 | Anderson et al. | |
| 2009/0251233 | A1 | 10/2009 | Mahon et al. | |
| 2010/0302116 | A1 | 12/2010 | Patrick et al. | |
| 2011/0254640 | A1 | 10/2011 | Gehring et al. | |
| 2012/0319804 | A1 | 12/2012 | Mahon et al. | |
| 2015/0054596 | A1 | 2/2015 | Rogers et al. | |
| 2015/0054702 | A1 | 2/2015 | Rogers | |
| 2015/0091671 | A1 | 4/2015 | Rogers et al. | |

OTHER PUBLICATIONS

Rogers, "Suppressing Modes in an Antenna Feed Including a Coaxial Waveguide", "U.S. Appl. No. 13/975,676, filed Aug. 26, 2013", Aug. 26, 2013, pp. 1-31, Published in: US.

Rogers et al., "Methods for RF Connections in Concentric Feeds", "U.S. Appl. No. 13/975,683, filed Aug. 26, 2013", Aug. 26, 2013, pp. 1-44, Published in: US.

Rogers et al., "An Inner-Tube With Opposing Shallow-Cavities for Use in a Coaxial Polarizer", "U.S. Appl. No. 14/039,872, filed on Sep. 27, 2013", , pp. 1-57, Published in: US.

* cited by examiner

MATCHING AND PATTERN CONTROL FOR DUAL BAND CONCENTRIC ANTENNA FEED

This invention was made with support under Government Contract No. H94003-04-D0005 awarded by the US Government to Northrop Grumman. The US Government may have certain rights in the invention.

BACKGROUND

In currently available multi-band antenna feeds that use concentrically positioned coaxial and circular waveguide structures, the coaxial aperture is physically large or flares out to a diameter that is larger than that of the coaxial waveguide. This increased aperture size compared to the wavelength of operation facilitates the impedance matching of the waveguide to the free space impedance. However, while these physically-large antenna feeds may be useful as single feed elements, they are too large for a plurality of such feeds to be positioned around a common spherical dielectric lens for use in switched beam antenna systems. A compact form factor for a dual band concentric antenna feed having coaxial and circular waveguides is needed in order for multiple feeds to be operably positioned around a common lens.

SUMMARY

The present application relates to a dual band concentric antenna feed. The dual band concentric antenna feed includes an outer conductive tube having an inner surface and an inner conductive tube having an outer surface. The inner conductive tube is positioned inside the outer conductive tube and is coaxially aligned to a shared axis that extends a length of the outer conductive tube and the inner conductive tube. A coaxial waveguide formed in a space between the inner surface of the outer conductive tube and the outer surface of the inner conductive tube supports a first frequency band. A circular waveguide formed within an inner surface of the inner conductive tube supports a second frequency band. The dual band concentric antenna feed also includes at least one transformer, a filter, and a plug in the coaxial waveguide. The filter is offset from the at least one transformer. An impedance locus associated with the filter is high-frequency capacitive within the first frequency band and low-frequency inductive within the first frequency band. The plug is offset from the at least one transformer and the filter and positioned near an aperture end of the concentric antenna feed.

DRAWINGS

Understanding that the drawings depict only exemplary embodiments and are not therefore to be considered limiting in scope, the exemplary embodiments will be described with additional specificity and detail through the use of the accompanying drawings, in which.

In accordance with common practice, the various described features are not drawn to scale but are drawn to emphasize features relevant to the present invention. Like reference characters denote like elements throughout figures and text.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

In order to overcome the problem described above, there is a need for special techniques to impedance match the coaxial aperture without increasing its size in a first frequency band. Additionally, a desire exists for methods which enable the gain pattern of the compact dual band concentric feed and lens antenna to be properly shaped in a second frequency band.

This application provides impedance matching in a first frequency band for a coaxial radiating element and a second frequency band with power radiating from the output of a circular waveguide of the dual band concentric antenna feed. The application also enables the antenna pattern in the second frequency band to be optimized for pattern shape and axial ratio. The dual band concentric antenna feeds described herein have a compact form factor so that multiple feeds can fit around a common lens. The compact dual band concentric antenna feeds described herein overcome the difficulty of prior art dual band concentric antenna feeds in providing impedance matching of the first frequency band at the coaxial aperture of the dual band concentric antenna feed and in optimizing the antenna pattern of the radiator for the second frequency band.

Figure 1:
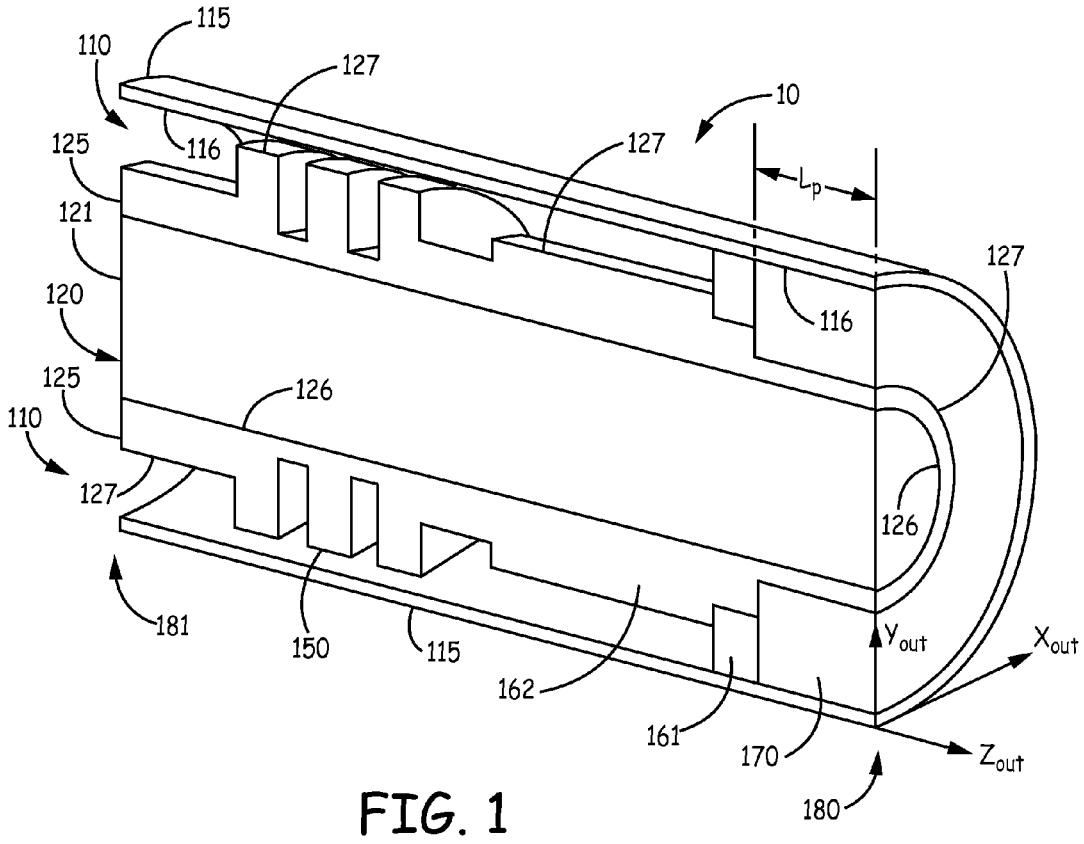
FIG. 1 is a three-dimensional cut-away cross-section view of an embodiment of a dual band concentric antenna feed.
Figure 2A:
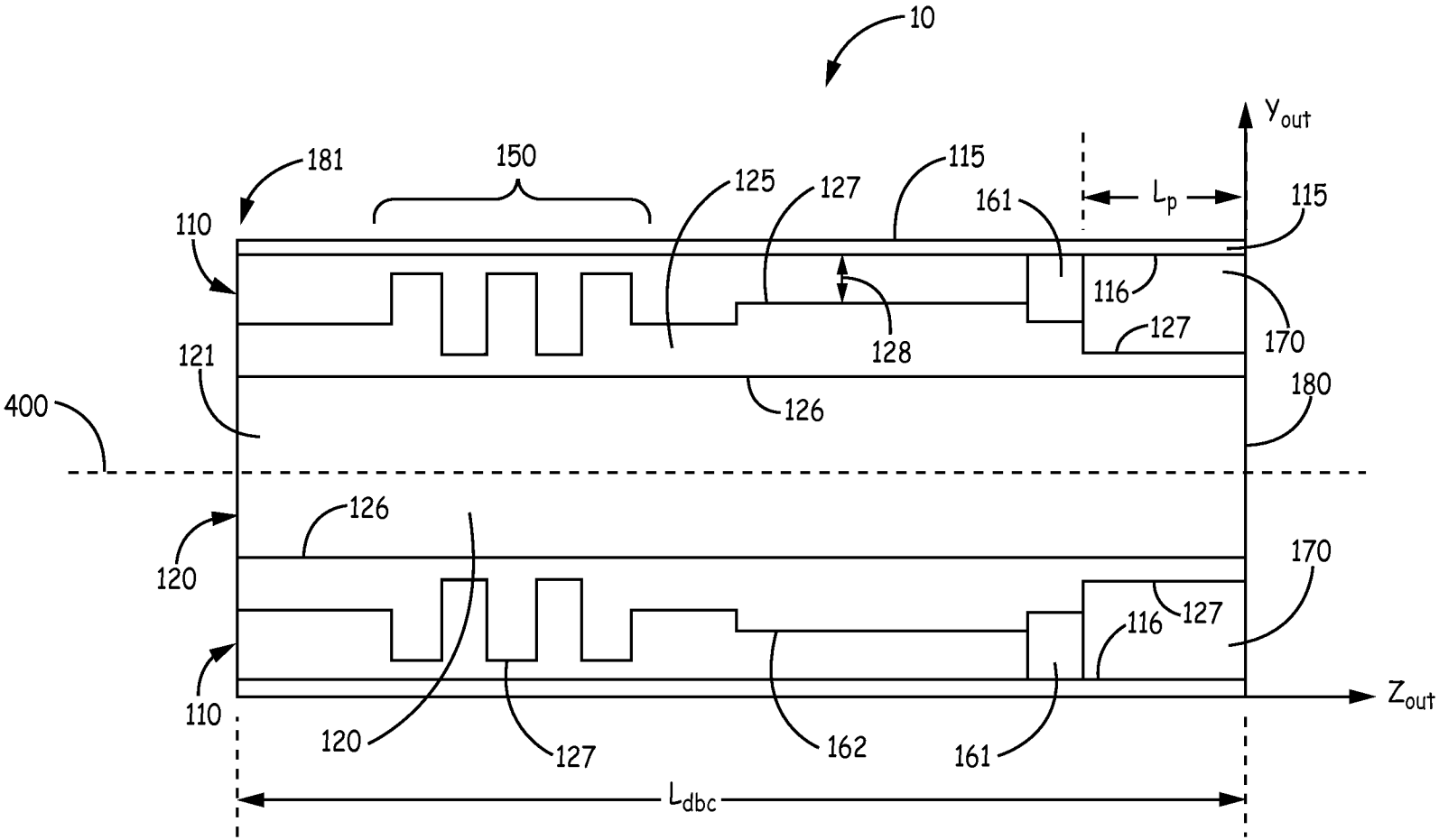
FIG. 2A is a cross-section side view of the dual band concentric antenna feed of FIG. 1.

FIG. 1 is a three-dimensional cut-away cross-section view of an embodiment of a dual band concentric antenna feed 10. FIG. 2A is a cross-section side view of the dual band concentric antenna feed 10 of FIG. 1. The dual band concentric antenna feed 10 includes an outer conductive tube 115 having an inner surface 116, an inner conductive tube 125 having an outer surface 127. The inner conductive tube 125 is positioned inside the outer conductive tube 115. The inner conductive tube 125 and the outer conductive tube 115 are coaxially aligned to a shared axis 400 (FIG. 2A) that extends a length (in the Z direction) of the outer conductive tube 115 and the inner conductive tube 125. The shared axis 400 is parallel to the $Z_{out}$ axis shown in FIGS. 1 and 2A. The outer conductive tube 115 has a cylindrical shape. An inner surface 126 of the inner conductive tube 125 is a smooth cylindrical shape.

A coaxial waveguide 110 is formed in a space between the inner surface 116 of the outer conductive tube 115 and the outer surface 127 of the inner conductive tube 125 and supports a first frequency band. A circular waveguide 120 is formed within an inner surface 126 of the inner conductive tube 125 and supports a second frequency band.

The dual band concentric antenna feed 10 also includes at least one transformer in the coaxial waveguide 110, a filter 150 in the coaxial waveguide 110, and a plug 170 in the coaxial waveguide 110. As shown in FIGS. 1 and 2A, the at least one transformer includes a first transformer 161 and a second transformer 162. The filter 150 is offset from the first transformer 161 and the second transformer 162. The plug 170 is offset from the first transformer 161, the second transformer 162, and the filter 150. The plug 170 is positioned at or near (e.g., within in millimeters) an aperture end represented generally at 180 of the concentric antenna feed 10. The output end 180 is also referred to herein as an "aperture end 180". The output end 180 of the dual band concentric antenna feed 10 spans an output plane ($X_{out}$, $Y_{out}$). The output plane ($X_{out}$, $Y_{out}$) is also referred to herein as an "aperture plane ($X_{out}$, $Y_{out}$)".

The first transformer 161, the second transformer 162, and the filter 150 are formed in the coaxial waveguide 110 to provide impedance matching for the dual band concentric antenna feed 10 in a first frequency band. As understood by one skilled in the art, as the return loss of a dual band concentric antenna feed decreases, the impedance of the dual band concentric antenna feed is better matched to the characteristic impedance of the input transmission line 191.

The plug 170 is formed in (fills) the space between the outer surface 127 of the inner conductive tube 125 and the inner surface 116 of the outer conductive tube 115 at the coaxial aperture in the plane ($X_{out}$, $Y_{out}$) of the dual band concentric antenna feed 10. The plug 170 has a plug length $L_p$ in the −Z direction from the aperture plane ($X_{out}$, $Y_{out}$). In the embodiment of FIGS. 1 and 2A, the plug length $L_p$ is approximately 90 electrical degrees in the first frequency band. A plug length $L_p$ of approximately 90 electrical degrees is equivalent to a quarter of a guide wavelength ($\lambda_g/4$) at the mid-frequency, which equals $(f_1+f_2)/2$. All references to 90 electrical degrees are referred to the mid-frequency. Likewise, all references to 40 electrical degrees are referred to the mid-frequency. The plug 170 is formed from a dielectric material.

As shown in FIGS. 1 and 2A, the outer surface 127 of the inner conductive tube 125 includes ribbed protrusions represented generally at 150. These ribbed protrusions change the transmission properties of the coaxial waveguide 110 in the region of the protrusions to achieve the desired filtering and impedance matching functions of the filter. The region of the ribbed protrusions is referred to herein as a "filter 150", a "coaxial filter 150", or a "filter/matching element 150". The filter 150 is used to improve the impedance matching of the dual band concentric antenna feed 10 in a first frequency band. In one implementation of this embodiment, the filter 150 is formed from the conductive material that forms the inner conductive tube 125. In another implementation of this embodiment, the filter includes rings that are arranged in the coaxial waveguide 110 of the inner conductive tube 125. Such rings are made from conductive material. In yet another embodiment, the rings are formed from the same metal as the inner conductive tube 125.

As shown in FIGS. 1 and 2A, the inner conductive tube 125 also includes a ring of material 161 and a protrusion 162. The protrusion 162 encircles the inner conductive tube 125 and is formed from the conductive material that forms the inner conductive tube 125. The ring of material 161 changes the characteristic impedance of the coaxial waveguide 110 in the region of the ring of material 161 to achieve the desired characteristic impedance of a first transformer. The region of the ring of material 161 is referred to herein as the "ring of material 161", "dielectric ring 161", a "first transformer stage 161", "first transformer 161" and "transformer 161".

Likewise, the protrusion 162 of the outer surface 127 of the inner conductive tube 125 changes the characteristic impedance of the coaxial waveguide 110 in the region of the protrusion 162 to achieve the desired characteristic impedance of a second transformer. The region of the protrusion 162 is referred to herein as a "second transformer stage 162" and "second transformer 162". As shown in FIG. 2A, there is an air gap 128 between the second transformer 162 and the inner surface 116 of the outer conductive tube 115. The terms "gap" and "air gap" are used interchangeably herein.

In one implementation of this embodiment, the first transformer 161 comprises a dielectric ring 161. As shown in FIG. 2A, the dielectric ring 161 contacts the inner surface 116 of the outer conductive tube 115. In another implementation of this embodiment, a negligible gap (on the order of one or two mils) exists between the inner surface 116 of the outer conductive tube 115 and the dielectric ring 161.

Figure 2B:
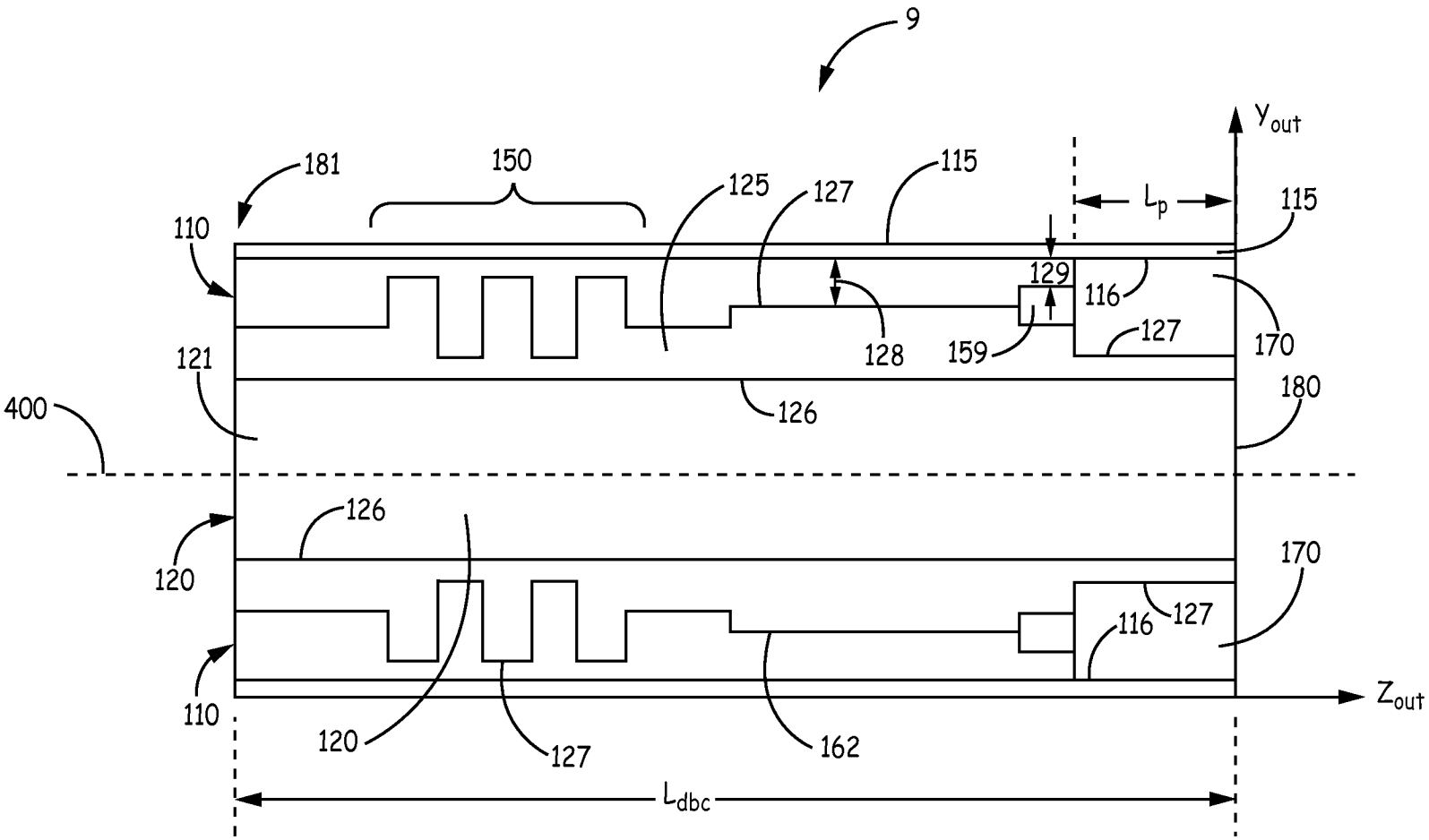
FIG. 2B is a cross-section side view of an embodiment of a dual band concentric antenna feed.

FIG. 2B is a cross-section side view of a dual band concentric antenna feed 9. The dual band concentric antenna feed 9 differs from the dual band concentric antenna feed 10 of FIGS. 1 and 2A, in that there is an air gap 129 between the first transformer 159 and the inner surface 116 of the outer conductive tube 115. The air gap 129 is also referred to herein as a "first air gap 129" and "first gap 129". The air gap 128 is also referred to herein as a "second air gap 128" and "second gap 128".

In one implementation of this embodiment, the first transformer 159 is formed in the coaxial waveguide 110 as a first protrusion 159 on the outer surface 127 of the inner conductive tube 125 and the second transformer 162 is formed in the coaxial waveguide 110 as a second protrusion 162 on the outer surface 127 of the inner conductive tube 125. In such an embodiment, the first protrusion 159 and the second protrusion 162 have different thicknesses and they are seamlessly formed on the outer surface 127 of the inner conductive tube 125. In this embodiment, the first gap 129 is between the first protrusion 129 and the inner surface 116 of the outer conductive tube 115, and the second gap 128 is between the second protrusion 162 and the inner surface 116 of the outer conductive tube 115.

In another implementation of this embodiment, the first transformer 159 is a ring of dielectric material 159. In yet another implementation of this embodiment, the first transformer 159 is a ring of conductive material 159. Hereafter, a reference to the dual band concentric antenna feed 10 can also be applied to the dual band concentric antenna feed 9 of FIG. 2B, as is understandable to one skilled in the art upon reading this document.

The dual band concentric antenna feed 10 includes a coaxial waveguide 110 formed in the space between the outer surface 127 of the inner conductive tube 125 and the inner surface 116 of the outer conductive tube 115. The coaxial waveguide 110 is configured to support the propagation of electromagnetic fields at a first band of frequencies. The dual band concentric antenna feed 10 also includes a circular waveguide 120 formed inside the inner conductive tube 125. The circular waveguide 120 is configured to support propagation of electromagnetic fields at a second band of frequencies. The first band of frequencies is also referred to herein as "band 1" or "first band". The second band of frequencies is also referred to herein as "band 2" or "second band". The second band of frequencies is at a higher frequency than the first band of frequencies. In the transmit case, the electromagnetic fields propagate from an input end represented generally at 181 to the output end 180 at the output plane ($X_{out}$, $Y_{out}$). The output end 180 at the output plane ($X_{out}$, $Y_{out}$) is offset from the plane of the input end 181 by a length $L_{dbc}$ (FIG. 2A) of the dual band concentric antenna feed 10. In the receive case, the electromagnetic fields propagate in the opposite direction within the dual band concentric antenna feed 10 from the output end 180 toward the input end 181.

As shown in FIGS. 1 and 2A, the inner conductive tube 125 is filled with a dielectric material 121 that is selected to lower the cutoff frequency of the circular waveguide 120 so that electromagnetic waves in the second frequency band propagate within the inner conductive tube 125. As known to those skilled in the art, use of dielectric material 121 allows the diameter of circular waveguide 120 (e.g., the inner diameter of the inner conductive tube 125) to be reduced. In one implementation of this embodiment, the inner conductive tube 125 is filled with air rather than the dielectric material 121.

In one implementation of this embodiment, the inner conductive tube 125 is formed in aluminum. In another implementation of this embodiment, the outer conductive tube 115 is formed in aluminum. In yet another implementation of this embodiment, the inner conductive tube 125 is formed in other metals. In yet another implementation of this embodiment, the outer conductive tube 115 is formed in in other metals.

The first transformer 161 and the second transformer 162 are constructed of dielectric rings and/or metal sections of varying diameters. The design of the first transformer 161 and the second transformer 162 depends upon the available room within the dual band concentric antenna feed 10. In one implementation of this embodiment, the first transformer 161 is a dielectric ring and the second transformer 162 is formed as a protrusion in the coaxial waveguide 110 (FIGS. 1 and 2A) of the inner conductive tube 125. There are various ways to achieve the desired characteristic impedance of a given transformer in the coaxial feed.

In one implementation of this embodiment, there is a step-out in the outer diameter of inner conductive tube 125 in the second transformer region to form the second transformer 162 so the second transformer 162 is a protrusion of the inner conductive tube 125. A dielectric ring having a specific dielectric constant is positioned adjacent to the step-out forms the first transformer 161 and completely fills the space between inner conductive tube 125 and outer conductive tube 115 (FIG. 2A).

In another implementation of this embodiment, the second transformer 162 is a protrusion of the inner conductive tube 125. The first transformer 159 is formed by partially filling the coaxial waveguide with a dielectric ring 159 (FIG. 2B) between outer surface 127 of the inner conductive tube 125 and outer conductive tube 115. In this case there is an air gap 129 between dielectric ring 159 and outer conductive tube 115.

In theory, the physical configurations of the first transformer 161 and the second transformer 162 are designed independently according to the embodiments described above. Thus, there are many conceivable combinations of the embodiments for the first transformer 161 and the second transformer 162 taken together. In practice, the first transformer 161 and the second transformer 162 must have physical designs that are compatible for practical assembly of the piece parts. For example, if a dielectric ring is used for the second transformer 162, the dielectric ring must be able to slide past any protrusion that comprises the first transformer 161. In one embodiment, the first transformer 161 and the second transformer 162 are formed from dielectric rings with the same or different inner diameter and with the same or different outer diameter. In this latter case, the first transformer 161 and the second transformer 162 are made as one piece part. In yet another embodiment, the first transformer 161 and the second transformer 162 are formed from dielectric rings and are made as part of the same piece part as plug 170.

The shape of the filter 150, the plug 170, the first transformer stage 161, and the second transformer stage 162 and the dielectric constant of the plug 170 and first transformer stage 161 are determined by modeling. The modeling techniques are now described with reference to FIGS. 3A-3D and 5A-10D.

Figure 3A:
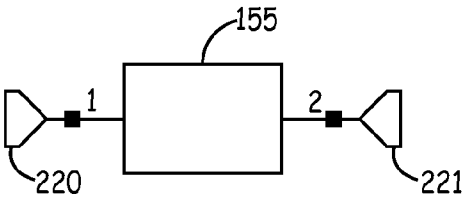
FIG. 3A is a circuit model for a coaxial filter.
Figure 3B:
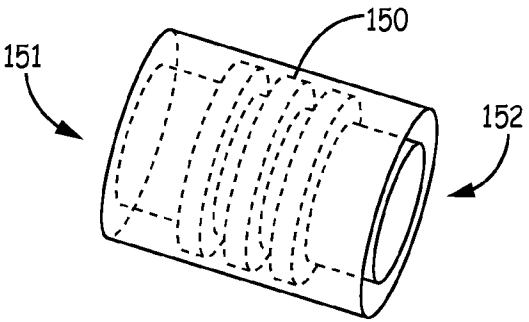
FIG. 3B is a physical model of the coaxial filter of FIG. 3A.

FIG. 3A is a circuit model for a coaxial filter 155, which is illustrated as a generic two port network. The circuit model for the coaxial filter 155 includes an input port 220 and an output port 221 that are separated by the length between points 1 and 2. FIG. 3B is a physical model of the coaxial filter 155 of FIG. 3A. The circuit model of the coaxial filter 155 of FIG. 3A represents physical model filter 150. The filter 150 of FIG. 3B includes an input port 151 that corresponds to the input port 220 of the circuit model of FIG. 3A and an output port 152 that corresponds to the output port 221 of the circuit model of FIG. 3A.

Figure 3C:
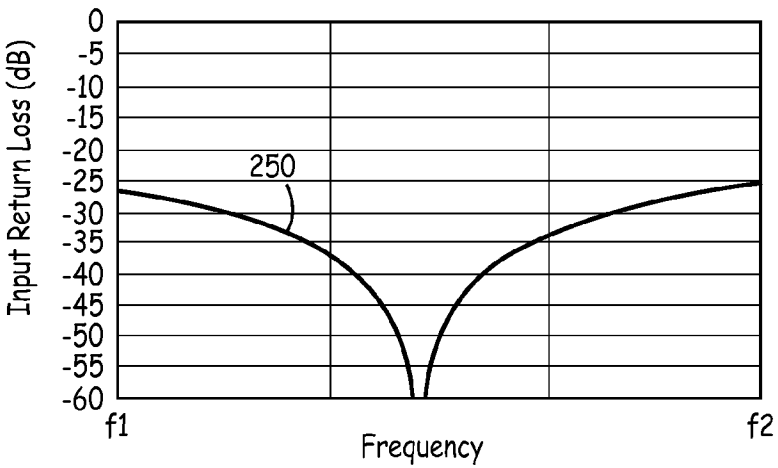
FIG. 3C is a plot of the return loss of the coaxial filter of FIG. 3A.
Figure 3D:
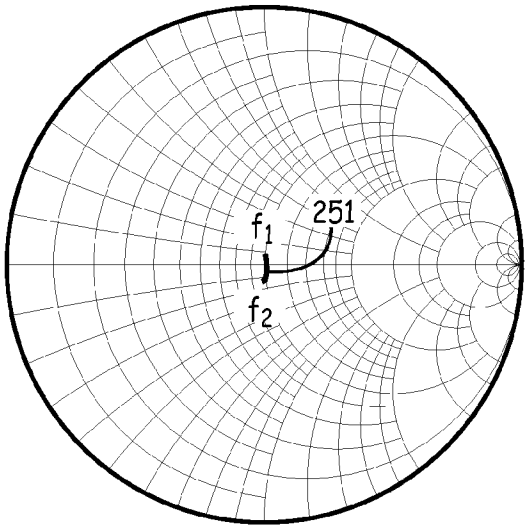
FIG. 3D is a Smith chart showing the input impedance of the filter of FIG. 3A.

FIG. 3C is a plot 250 of the return loss of the coaxial filter 155 of FIG. 3A. Plot 250 spans the frequency range for the first band of frequencies (i.e., between frequency $f_1$ and frequency $f_2$). As shown in FIG. 3C, at the edges of the first band (i.e., near frequency $f_1$ and near frequency $f_2$), the return loss is at or less than −25 dB. FIG. 3D is a Smith chart showing the input impedance of the filter 155 of FIG. 3A. The real axis of the Smith chart is the horizontal line that bisects the Smith chart. Each plot on the Smith charts shown in FIGS. 3D, 5D, 6D, 7D, 8D, 9D, and 10D is referred to herein as an "impedance locus". The impedance locus 251 shown on the Smith chart of FIG. 3D, shows that the impedance is inductive at frequency $f_1$ (i.e., above the real axis) and the impedance is capacitive at frequency $f_2$ (i.e., below the real axis). The impedance locus 251 depicts the input impedance of input port 220 of coaxial filter 155 with the output port 221 match terminated. At a frequency approximately midway between $f_1$ and $f_2$, the impedance locus passes through the center of the Smith chart indicating a near perfect impedance match. Thus, the coaxial filter 155 is high-frequency (e.g., frequency $f_2$) capacitive within the first frequency band (e.g., from $f_1$ and $f_2$) and is low-frequency (e.g., frequency $f_1$) inductive within the first frequency band. The relative short length of the impedance locus 251 near the center of the Smith chart indicates that the impedance is relatively well matched from frequency $f_1$ to frequency $f_2$.

Figure 4:
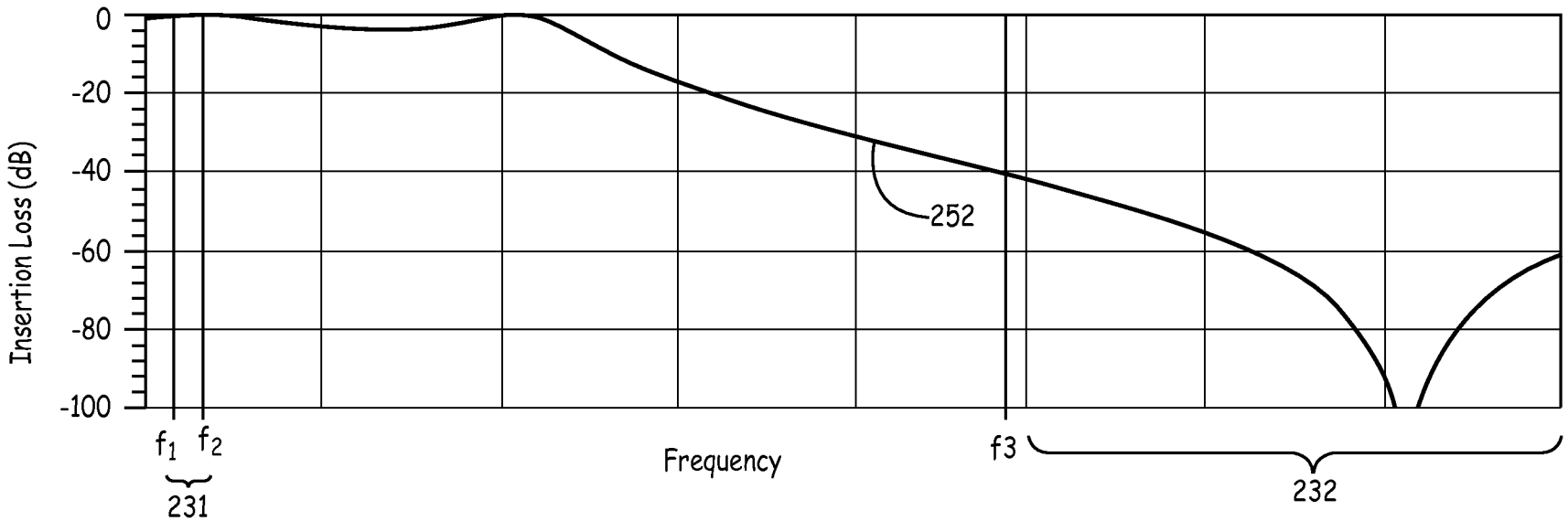
FIG. 4 is a plot of the insertion loss of the coaxial filter of FIG. 3A over a wide band of frequencies.

FIG. 4 is a plot of the insertion loss of the coaxial filter 155 of FIG. 3A over a wide band of frequencies. The first band of frequencies from frequency $f_1$ to frequency $f_2$ is represented generally at 231. The second band of frequencies is represented generally at 232 and includes the frequencies above the frequency $f_3$. As shown in FIG. 4, the filter 150 is a low-pass filter since it "passes" band 1 energy (first band 231 of frequencies) and rejects, to better than −40 dB, the frequencies in band 2 (second band 232 of frequencies) above frequency $f_3$. The −40 dB rejection in band 2 is from input port 220 to the output port 221 (and vice versa) in FIG. 3A.

In the following description related to FIGS. 5A-10D, FIGS. 5A, 6A, 7A, 8A, 9A, and 10A show circuit models for respective coaxial waveguide feeds of the dual band concentric antenna feeds of FIGS. 5B, 6B, 7B, 8B, 9B, and 10B. A coaxial waveguide feed is the coaxial component of a dual band concentric antenna feed, as known to one skilled in the art. Likewise, FIGS. 5C, 6C, 7C, 8C, 9C, and 10C show the return loss for the respective coaxial waveguide feeds of the dual band concentric antenna feeds of FIGS. 5B, 6B, 7B, 8B, 9B, and 10B. FIGS. 5D, 6D, 7D, 8D, 9D, and 10D show the Smith charts for the respective coaxial waveguide feeds of the dual band concentric antenna feeds of FIGS. 5B, 6B, 7B, 8B, 9B, and 10B. However, to simplify the description, it is understood to those skilled in the art that the term "dual band concentric antenna feed" may be used in place of "coaxial waveguide feed of the dual band concentric antenna feed" when referring to FIGS. 5A, 6A, 7A, 8A, 9A, 10A, 5C, 6C, 7C, 8C, 9C, 10C, 5D, 6D, 7D, 8D, 9D, and 10D. Said differently, it is implied that the results refer to the coaxial waveguide feed of the dual band concentric antenna feed and not the circular waveguide feed of the dual band concentric antenna feed (even if the term "coaxial" is not mentioned) when referring to FIGS. 5A, 6A, 7A, 8A, 9A, 10A, 5C, 6C, 7C, 8C, 9C, 10C, 5D, 6D, 7D, 8D, 9D, and 10D.

Figure 5A:
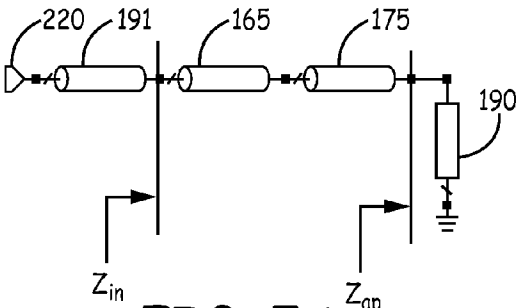
FIG. 5A is a first-band circuit model of a dual band concentric antenna feed including a plug and a transformer in series.
Figure 5C:
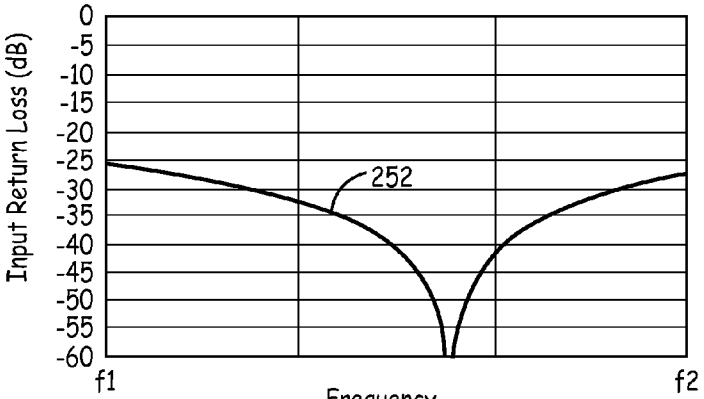
FIG. 5C is a plot of the first-band return loss of the dual band concentric antenna feed calculated from the first-band circuit model of FIG. 5A.
Figure 5B:
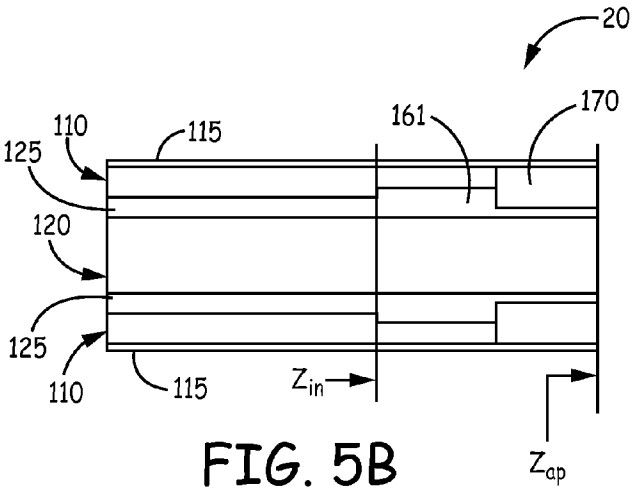
FIG. 5B is a physical model of a dual band concentric antenna feed including a plug and a transformer in series corresponding to the first-band circuit model of FIG. 5A.

FIG. 5A is a first-band circuit model for a dual band concentric antenna feed having a plug 175 and a transformer 165 in series. FIG. 5B is a physical model of the dual band concentric feed having a plug 170 and transformer 161 in series. The components 191, 165, and 175 in the circuit model of FIG. 5A are transmission line circuit elements which correspond to sections of the physical coaxial feed model of FIG. 5B. Each transmission line circuit element is represented by its own characteristic impedance, propagation constant, and physical length. In the circuit model, the propagation constant and the physical length are replaced by an equivalent electrical length at a specified frequency usually chosen to be the arithmetic mean of $f_1$ and $f_2$. The $TE_{11}$ mode is the desired mode of electromagnetic wave propagation in the coaxial feed and all characteristic impedances are calculated with respect to this mode. The plug 175 and transformer 165 are in series with an input transmission line 191, which has the same characteristic impedance as the input port 220. These transmission line circuit elements 191, 165, and 175 lead to and feed the parallel aperture impedance 190 ($Z_{ap}$) of the coaxial aperture in the output plane ($X_{out}$, $Y_{out}$). The parallel aperture impedance 190 ($Z_{ap}$) at the aperture (output) plane is also referred to herein as a "shunt coaxial aperture impedance 190". As shown in FIG. 5A, the input impedance of the feed ($Z_{in}$) is defined as the impedance terminating the input transmission line 191; i.e., it is the impedance as observed looking into the equivalent circuit of the transformer 165, the plug 175, and the shunt coaxial aperture impedance 190.

Figure 5D:
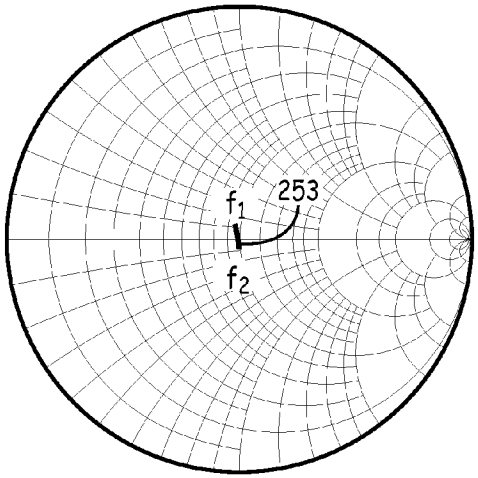
FIG. 5D is a Smith chart showing the first-band input impedance of the dual band concentric antenna feed calculated from the first-band circuit model of FIG. 5A.

The circuit model of the plug 175 of FIG. 5A represents the physical model of the plug 170 of FIG. 5B. Likewise, the circuit model of transformer 165 of FIG. 5A represents the physical model transformer 161 of FIG. 5B. The serially arranged plug 170 and the transformer 161 of FIG. 5B form a dual band concentric antenna feed 20. The reference plane for the input impedance ($Z_{in}$) in FIG. 5B correlates to the reference plane for the input impedance ($Z_{in}$) in FIG. 5A. The reference plane for the aperture impedance ($Z_{ap}$) in FIG. 5B correlates to the reference plane for the aperture impedance 190 in FIG. 5A. FIG. 5C is a plot of the return loss 252 of the coaxial feed circuit model of FIG. 5A with respect to the input port 220. As shown in FIG. 5C, at the edges of the first band (i.e., near frequency $f_1$ and near frequency $f_2$), the return loss is at or less than −25 dB. FIG. 5D is a Smith chart showing the input impedance ($Z_{in}$) of the circuit model of FIG. 5A. The relative short length of the impedance locus 253 indicates that the impedance is relatively well matched from frequency $f_1$ to frequency $f_2$. The impedance locus 253 shown on the Smith chart of FIG. 5D, shows that the impedance is inductive at frequency $f_1$ and the impedance is capacitive at frequency $f_2$. With a single transformer 161, the coaxial aperture is well-matched, and is low-frequency ($f_1$) inductive and high frequency ($f_2$) capacitive. This is similar to the filter impedance locus shown in FIG. 3D for filter 150.

Figure 6A:
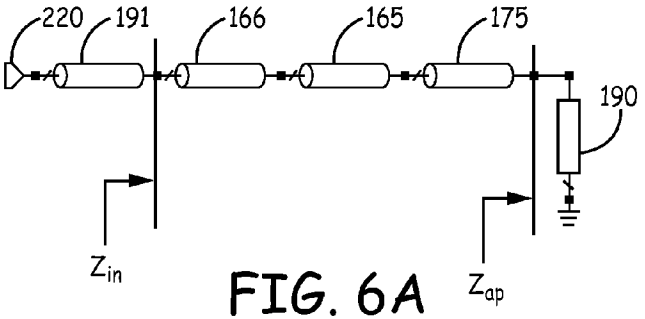
FIG. 6A is a first-band circuit model of a dual band concentric antenna feed including a plug and a two-stage transformer in series.
Figure 6B:
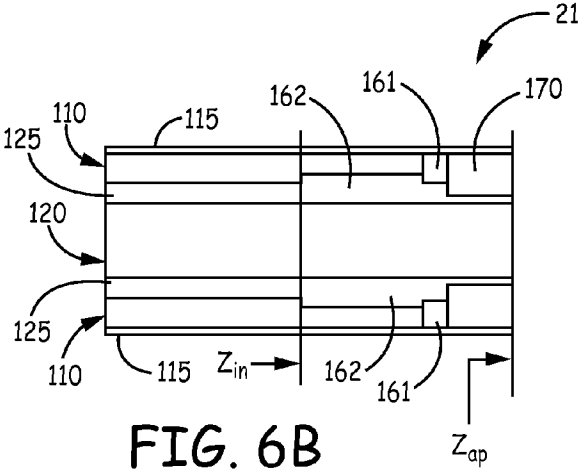
FIG. 6B is a physical model of a dual band concentric antenna feed including a plug and a two-stage transformer in series corresponding to the first-band circuit model of FIG. 6A.

FIG. 6A is a first-band circuit model for a dual band concentric antenna feed having a plug 175 and a two-stage transformer 165 and 166 in series. FIG. 6B is a physical model of the dual band concentric antenna feed 21 having the plug 175 and the two-stage transformer 165 and 166 of FIG. 6A. The components 191, 166, 165, and 175 in the circuit model of FIG. 5A are transmission line circuit elements which correspond to sections of the physical coaxial feed model of FIG. 6B. Each transmission line circuit element is represented by its own characteristic impedance, propagation constant, and physical length. In the circuit model, the propagation constant and the physical length are replaced by an equivalent electrical length at a specified frequency usually chosen to be the arithmetic mean of $f_1$ and $f_2$. The $TE_{11}$ mode is the desired mode of electromagnetic wave propagation in the coaxial feed and all characteristic impedances are calculated with respect to this mode. The plug 175, the first transformer 165, and the second transformer 166 are in series with an input transmission line 191, which has the same characteristic impedance as the input port 220. These transmission line circuit elements 191, 165, 166, and 175 lead to and feed the parallel aperture impedance 190 ($Z_{ap}$) at the aperture (output) plane ($X_{out}$, $Y_{out}$). The parallel aperture impedance 190 ($Z_{ap}$) of the coaxial aperture in the output plane is also referred to herein as a "shunt coaxial aperture impedance 190". As shown in FIG. 6A, the input impedance of the feed ($Z_{in}$) is defined as the impedance terminating the input transmission line 191; i.e., it is the impedance as observed looking into the equivalent circuit of the second transformer 166, the first transformer 165, the plug 175, and the shunt coaxial aperture impedance 190.

The circuit model of the plug 175 of FIG. 6A represents the plug 170 of FIG. 6B. Likewise, the circuit model of first transformer 165 of FIG. 6A represents the physical model of the first transformer 161 of FIG. 6B and the circuit model of second transformer 166 of FIG. 6A represents the physical model of the second transformer 162 of FIG. 6B.

The reference plane for the input impedance ($Z_{in}$) in FIG. 6B correlates to the reference plane for the input impedance ($Z_{in}$) in FIG. 6A. The plug 170, the first transformer 161, and the second transformer 162 of FIG. 6B in series form the coaxial portion of the dual band antenna feed 21. The plug 170 has a length of approximately 90 electrical degrees in the first frequency band (i.e., at $f_{mid}=(f_1+f_2)/2$).

Figure 6C:
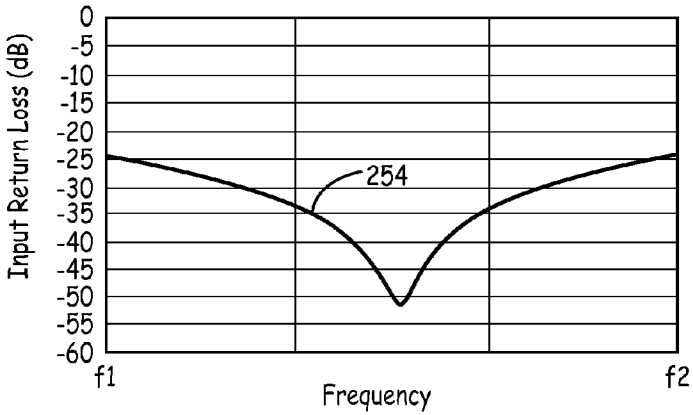
FIG. 6C is a plot of the first-band return loss of the dual band concentric antenna feed calculated from the first-band circuit model of FIG. 6A.
Figure 6D:
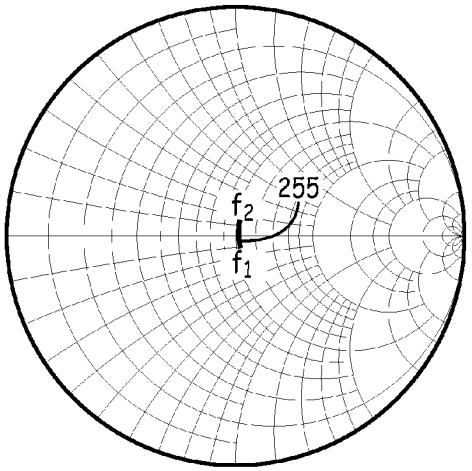
FIG. 6D is a Smith chart showing the first-band input impedance of the dual band concentric antenna feed calculated from the first-band circuit model of FIG. 6A.

FIG. 6C is a plot 254 of the return loss referenced to input port 220 of the coaxial feed circuit model of FIG. 6A having plug 175 and the two-stage transformer 165 and 166. As shown in FIG. 6C, at the edges of the first band (i.e., near frequency $f_1$ and near frequency $f_2$), the return loss is at or less than −25 dB. FIG. 6D is a Smith chart showing the input impedance ($Z_{in}$) of the coaxial feed of FIGS. 6A and 6B. The impedance locus 255 shown on the Smith chart of FIG. 6D, shows that the impedance is high frequency (e.g., frequency $f_2$) inductive within the first frequency band (e.g., from $f_1$ to $f_2$) and the impedance is low frequency (e.g., frequency $f_1$) capacitive within the first frequency band. As shown in FIG. 6D, the input impedance looking into the equivalent circuit of the second transformer 166, the first transformer 165, the plug 175, and the shunt coaxial aperture impedance 190 is low-frequency capacitive in the first frequency band and is high-frequency inductive in the first frequency band. This differs from the impedance loci 251 and 253 of FIGS. 3D and 5D, respectively, in which the impedance is high-frequency (e.g., frequency $f_2$) capacitive within the first frequency band and is low-frequency (e.g., frequency $f_1$) inductive within the first frequency band.

Figure 7B:
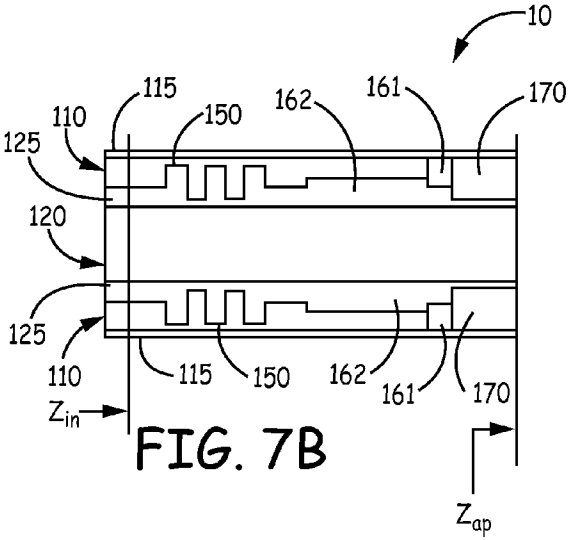
FIG. 7B is a physical model of the dual band concentric antenna feed including a plug, a two-stage transformer, and a filter in series corresponding to the first-band circuit model of FIG. 7A.
Figure 7D:
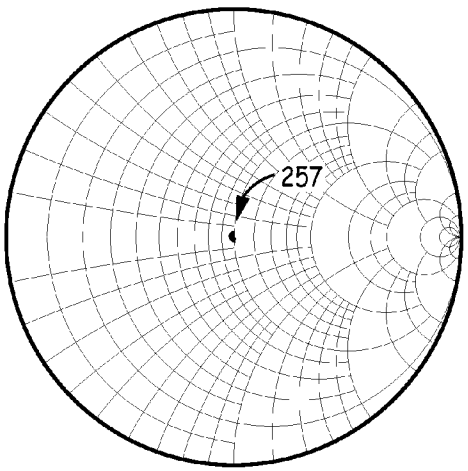
FIG. 7D is a Smith chart showing the first-band input impedance of the dual band concentric antenna feed calculated from the first-band circuit model of FIG. 7A.
Figure 7A:
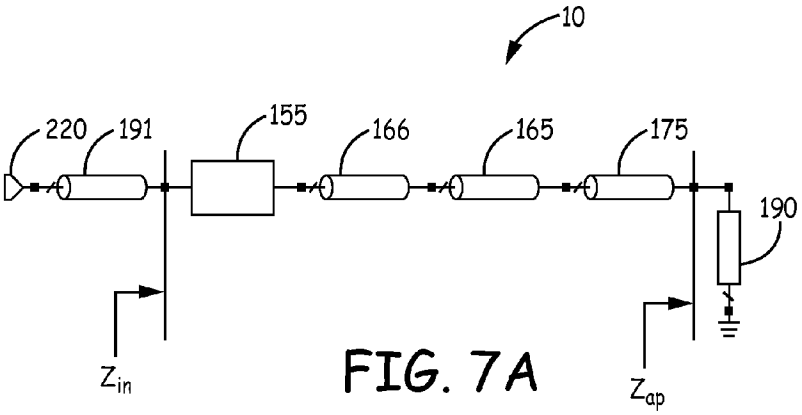
FIG. 7A is a first-band circuit model of a dual band concentric antenna feed including a plug, a two-stage transformer, and a filter in series.

FIG. 7A is a first-band circuit model of the dual band concentric antenna feed 10 (FIGS. 1 and 2A). The first-band circuit model of the dual band concentric antenna feed 10 includes a plug 175, a two-stage transformer 165 and 166, and a filter 155 in series. FIG. 7B is a physical model of the dual band concentric antenna feed 10 corresponding to the circuit model of FIG. 7A. FIG. 7B differs from FIG. 6B by the addition of a filter 150 to the dual band concentric antenna feed 21 of FIG. 6B. The circuit model of the plug 175 of FIG. 7A represents the physical model plug 170 of FIG. 7B. The circuit model of first transformer 165 of FIG. 7A represents the physical model of the first transformer 161 of FIG. 7B and the circuit model of second transformer 166 of FIG. 7A represents the physical model of the second transformer 162 of FIG. 7B. The circuit model of filter 155 of FIG. 7A represents the physical model of the filter 150 of FIG. 7B. The plug 170, the first transformer 161, and the second transformer 162, and filter 150 of FIG. 7B in series form the dual band concentric antenna feed 10 shown in FIGS. 1 and 2A. The first transformer 161 is positioned between the plug 170 and the second transformer 162. The second transformer 162 is positioned between the filter 150 and the first transformer 161.

Figure 7C:
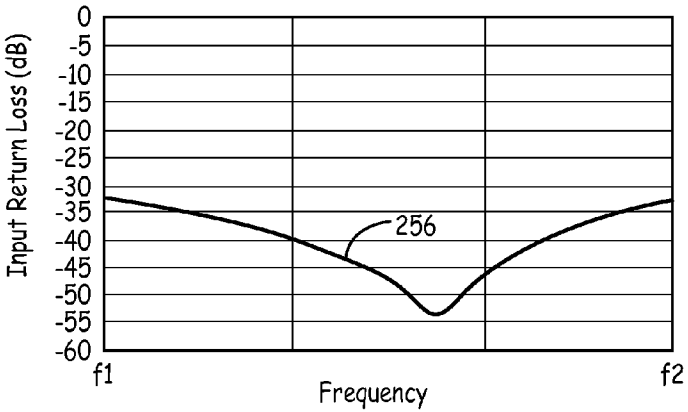
FIG. 7C is a plot of the first-band return loss of the dual band concentric antenna feed calculated from the first-band circuit model of FIG. 7A.

FIG. 7C is a plot 256 of the return loss of the dual band concentric antenna feed 10 of FIG. 7A. As shown in FIG. 7C, at the edges of the first band (i.e., near frequency $f_1$ and near frequency $f_2$), the return loss is at or less than −30 dB. FIG. 7D is a Smith chart showing the input impedance in the first frequency band of the dual band concentric antenna feed 10 of FIG. 7A. FIGS. 7A-7D show a dual band concentric antenna feed in which the impedance of the filter counteracts the feed impedance of FIGS. 6A-6D.

As shown in FIG. 7D, the addition of the filter 150 to the dual band concentric antenna feed 21 of FIG. 6B causes the impedance locus 257 of the Smith chart to collapse to almost a point and, thus, provides a return loss less than −30 dB over the band of interest (i.e., from $f_1$ to $f_2$). This collapse of the impedance locus 257 is produced by using the two transformers 161 and 162 (FIG. 6B), which provide a feed input impedance that is low-frequency capacitive in the first frequency band and high-frequency inductive in the first frequency band, in series with the filter 150 (FIG. 3), which has an impedance that is high-frequency capacitive in the first frequency band and low-frequency inductive in the first frequency band. The small diameter of the impedance locus 257 centered on the Smith chart indicates that the impedance (i.e., the shunt coaxial aperture impedance 190) is well matched from frequency $f_1$ to frequency $f_2$. In this manner, good performance (e.g., very low input return loss and excellent impedance matching) is obtained for the dual band concentric antenna feed 10 in the first frequency band. Thus, the input impedance of the coaxial feed physically consisting of a plug 170, a two-stage transformer 161 and 162, and a filter 155 in series is very well matched across all of the first band 231 of frequencies from frequency $f_1$ to frequency $f_2$.

Figure 8A:
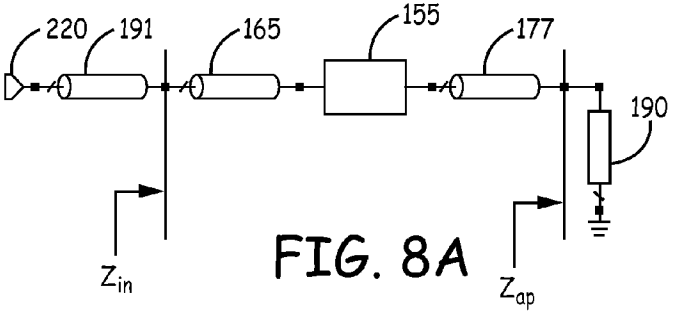
FIG. 8A is a first-band circuit model of a dual band concentric antenna feed including a plug (90 electrical degrees), a filter, and a transformer in series.
Figure 8B:
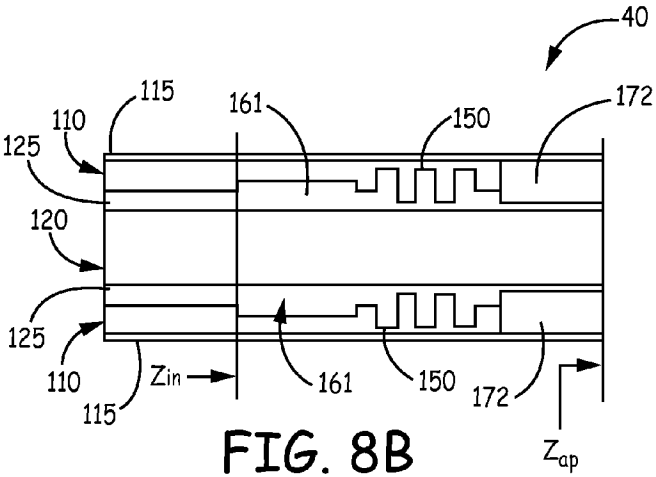
FIG. 8B is a physical model of a dual band concentric antenna feed including a plug (90 electrical degrees), a filter, and a transformer in series corresponding to the first-band circuit model of FIG. 8A.
Figure 8C:
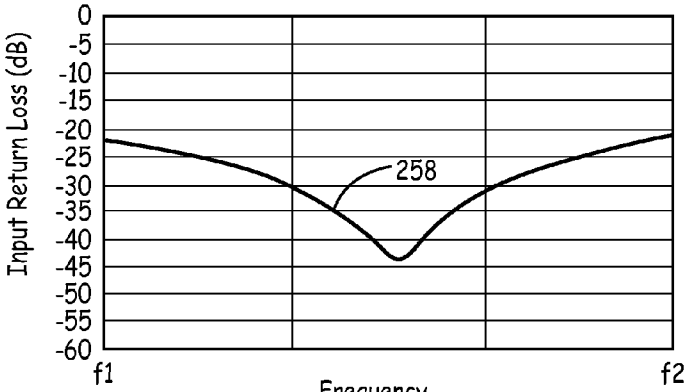
FIG. 8C is a plot of the first-band return loss of the dual band concentric antenna feed calculated from the first-band circuit model of FIG. 8A.
Figure 8D:
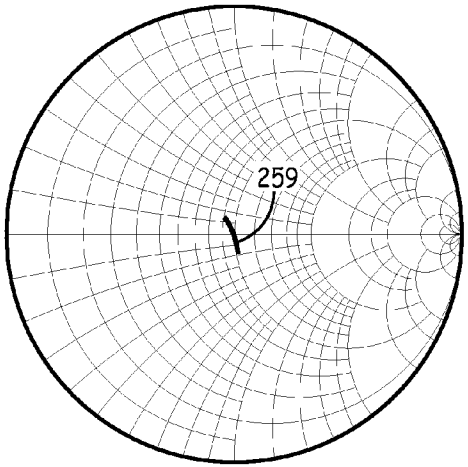
FIG. 8D is a Smith chart showing the input impedance of the dual band concentric antenna feed calculated from the first-band circuit model of FIG. 8A.

Another embodiment of a dual band concentric antenna feed improves the second-band antenna gain pattern when used with a lens and provides good, but not optimal, first-band impedance matching is shown in FIGS. 8A-8D. FIG. 8A is a first-band circuit model for the dual band concentric antenna feed having a plug 177 (90 electrical degrees), a filter 155, and a transformer 165 in series. The circuit model of the plug 177 of FIG. 8A represents the physical model of the plug 172 of FIG. 8B. The reference plane for the input impedance ($Z_{in}$) in FIG. 8B correlates to the reference plane for the input impedance ($Z_{in}$) in FIG. 8A. The plug 172 has a length of 90 electrical degrees in the first frequency band. The circuit model of filter 155 of FIG. 8A represents the physical model filter 150 of FIG. 8B. Likewise, the circuit model of transformer 165 of FIG. 8A represents the physical model transformer 161 of FIG. 8B. The plug 172, the filter 150, and the transformer 161 of FIG. 8B in series form a dual band concentric antenna feed 40. As shown in FIG. 8B, the filter 150 is positioned between the transformer 161 and the plug 172. The filter/matching element 150 is positioned directly, or almost directly, behind the plug 172. The matching transformer 161 is shown after the filter/matching element 150. FIG. 8C is a plot of the return loss of the dual band concentric antenna feed 40 of FIGS. 8A and 8B. As shown in FIG. 8C, at the edges of the first band (i.e., near frequency $f_1$ and near frequency $f_2$), the return loss is less than −20 dB. FIG. 8D is a Smith chart showing the input impedance of the dual band concentric antenna feed 40 of FIG. 8A. The relatively short length of the impedance locus 259 indicates that the impedance is relatively well matched.

Figure 9A:
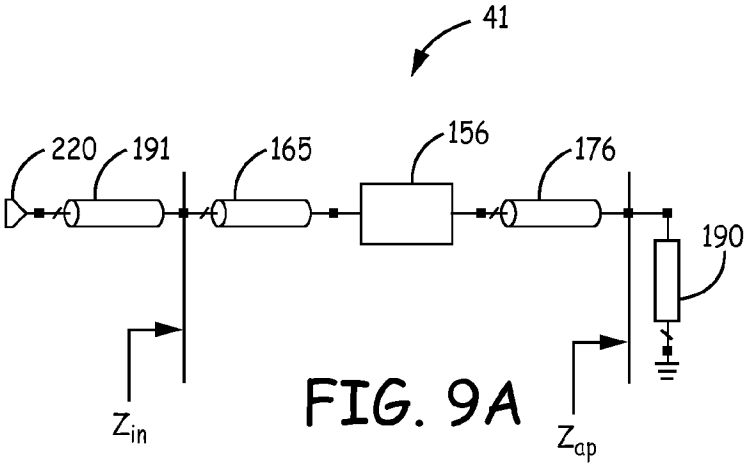
FIG. 9A is a first-band circuit model of a dual band concentric antenna feed including a plug (40 electrical degrees), a filter, and a transformer in series.
Figure 9B:
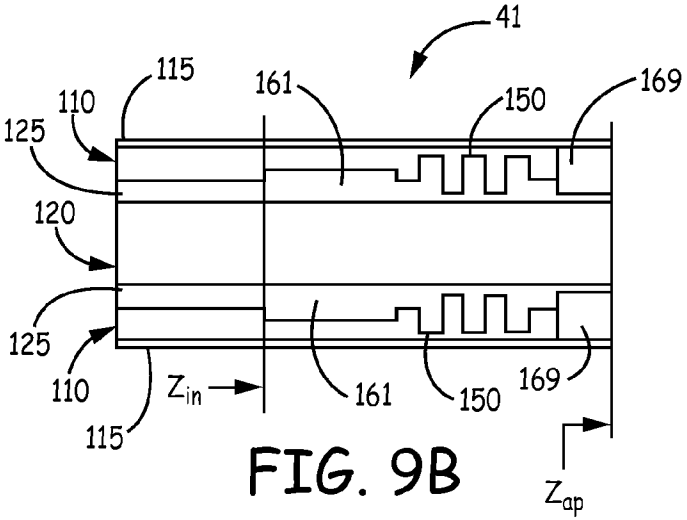
FIG. 9B is a physical model of a dual band concentric antenna feed including a plug (40 electrical degrees), a filter, and a transformer in series corresponding to the first-band circuit model of FIG. 9A.
Figure 9C:
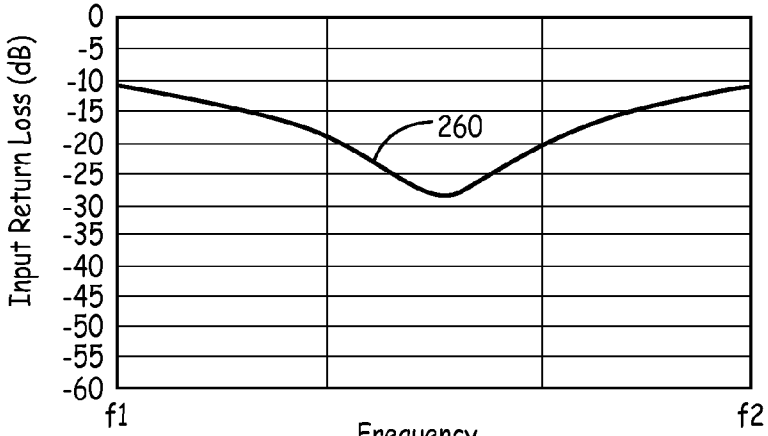
FIG. 9C is a plot of the first-band return loss of the dual band concentric antenna feed calculated from the first-band circuit model of FIG. 9A.
Figure 9D:
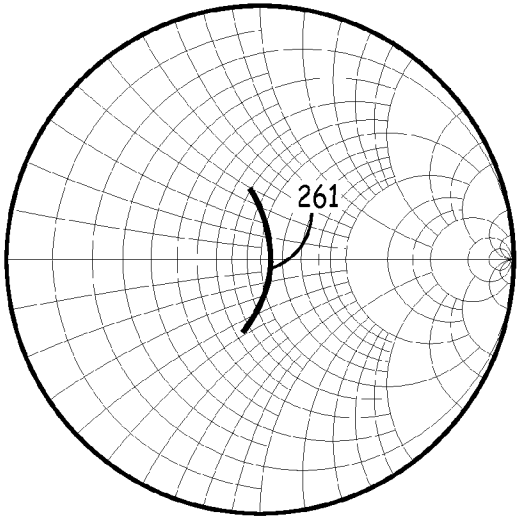
FIG. 9D is a Smith chart showing the first-band input impedance of the dual band concentric antenna feed calculated from the first-band circuit model of FIG. 9A.

FIG. 9A is a first-band circuit model of the dual band concentric antenna feed 41 having a plug 176, a filter 156, and a transformer 165 in series. FIG. 9B is a physical model of the dual band concentric antenna feed of FIG. 9A. The circuit model of the plug 176 of FIG. 9A represents the physical model of the plug 169 of FIG. 9B. The plug 169 has a length of 40 electrical degrees in the first frequency band. FIG. 9C is a plot of the return loss of the dual band concentric antenna feed of FIG. 9A. As shown in FIG. 9C, at the edges of the first band (i.e., near frequency $f_1$ and near frequency $f_2$), the return loss is at or less than −10 dB, which is relatively high compared to the return loss of the dual band concentric antenna feed 10 shown in FIG. 7C. FIG. 9D is a Smith chart showing the input impedance of the dual band concentric antenna feed of FIG. 9A. The relatively long length of the impedance locus 261 indicates that the impedance is not very well matched from frequency $f_1$ to frequency $f_2$. The relatively high return loss and mismatched impedance of the dual band concentric antenna feed 41 is due to the length of the plug 169 being significantly less than the optimal 90 degrees, e.g., 40 electrical degrees in this case. By decreasing the plug length from 90 electrical degrees in FIG. 8B to 40 electrical degrees in FIG. 9B, the return loss and the impedance locus in the dual band concentric antenna feed 41 is degraded from that of the dual band concentric antenna feed 40 of FIG. 8B. The input return loss and the impedance locus are significantly affected by the distance between the filter 150 and the output aperture of the dual band concentric antenna feed. This distance includes the plug length and any additional space between the plug 169 or 172 and the filter 150.

Figure 10B:
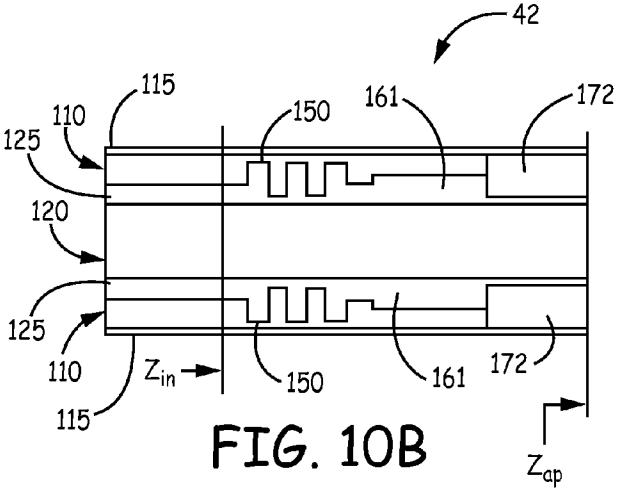
FIG. 10B is a physical model of a dual band concentric antenna feed including a plug (90 electrical degrees), a transformer, and a filter corresponding to the first-band circuit model of FIG. 10A.
Figure 10D:
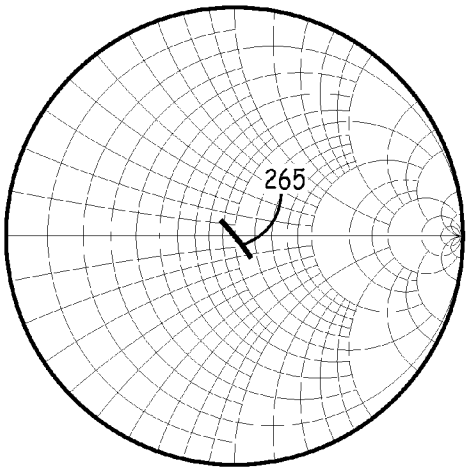
FIG. 10D is a Smith chart showing the first-band input impedance of the dual band concentric antenna feed calculated from the first-band circuit model of FIG. 10A.
Figure 10A:
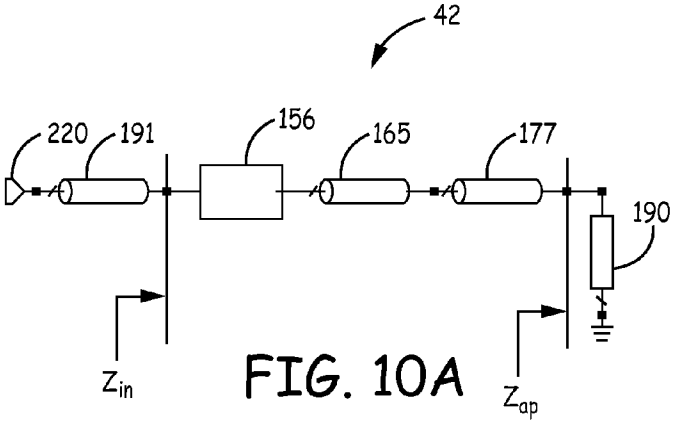
FIG. 10A is a first-band circuit model of a dual band concentric antenna feed including a plug (90 electrical degrees), a transformer, and a filter in series.
Figure 10C:
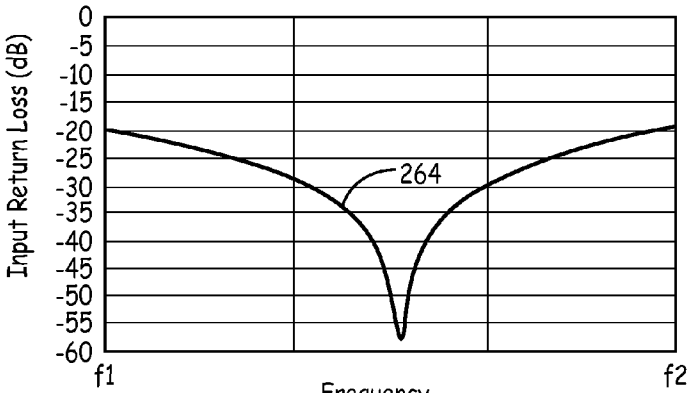
FIG. 10C is a plot of the first-band return loss of the dual band concentric antenna feed calculated from the first-band circuit model of FIG. 10A.

FIG. 10A is a first-band circuit model of the dual band concentric antenna feed having a plug 177 (90 electrical degrees in the first frequency band), a transformer 165, and a filter 156 in series. FIG. 10B is a physical model of the dual band concentric antenna feed 42 of FIG. 10A. FIG. 10C is a plot of the return loss of the dual band concentric antenna feed 42 of FIG. 10A. As shown in FIG. 10C, at the edges of the first band (i.e., near frequency $f_1$ and near frequency $f_2$), the return loss is approximately −20 dB. FIG. 10D is a Smith chart showing the input impedance of the dual band concentric antenna feed 42 of FIG. 10A.

One purpose of the filter/matching element 150 is to prevent electromagnetic waves in the second frequency band from propagating in the coaxial waveguide 110. A second function of the filter/matching element 150 is to provide optimal matching of the coaxial aperture in conjunction with two transformers as shown in FIGS. 7A and 7B. In some applications due to size or cost constraints, there is only one transformer in the dual band concentric feed design. In this case it is helpful to examine the effects on the location of a single transformer relative to the filter 150. This is done by comparing FIGS. 8A-8D to FIGS. 10A-10D. For the purpose of impedance matching in the coaxial aperture for band 1, the embodiment of FIG. 8B having the order of elements (from the output aperture end) as a plug, a filter, and a transformer is slightly better than the embodiment of FIG. 10B having the order of elements (from the output aperture end) as a plug, a transformer, and a filter. FIG. 8C demonstrates a return loss of −21 to −22 dB at the band edges while FIG. 10C shows approximately −20 dB.

Figure 11:
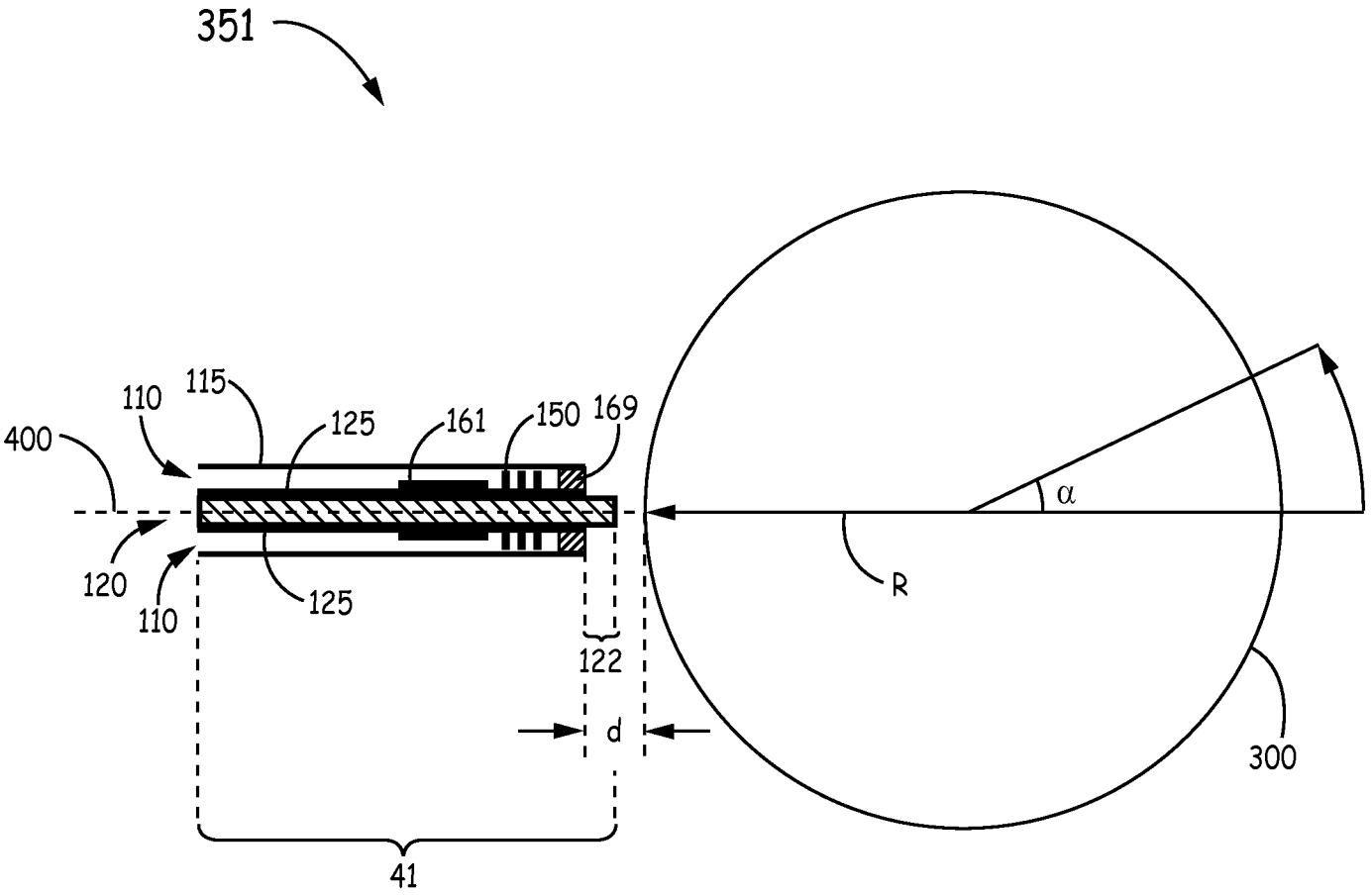
FIGS. 11 and 12 are cross-sectional side views of dual band concentric feeds arranged with a lens.
Figure 12:
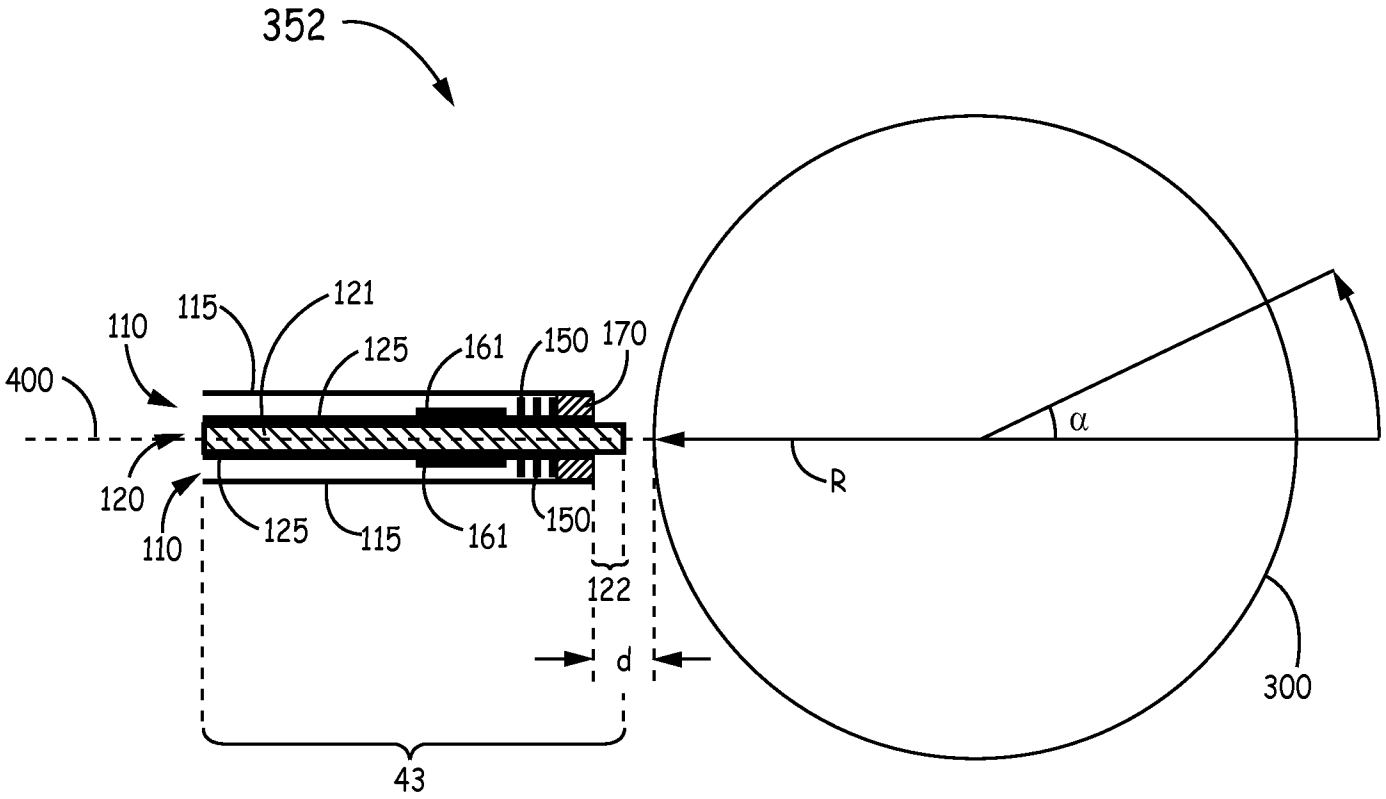

FIGS. 11 and 12 are cross-sectional side views of dual band concentric feeds 41 and 43, respectively arranged with a lens 300. An antenna system 351 (FIG. 11) is formed by the dual band concentric feed 41 and the lens 300. An antenna system 352 (FIG. 12) is formed by the dual band concentric feed 43 and the lens 300. The inner conductive tube 125 is filled with a dielectric material 121. The dual band concentric feed 41 in FIG. 11 is arranged so that that a shared axis 400 (i.e., the Z axis of FIG. 2A) of the dual band concentric feed 41 is parallel to and overlaps a radius represented generally at R of the lens 300. Similarly, the dual band concentric feed 43 in FIG. 12 is arranged so that that the shared axis 400 of the dual band concentric feed 43 is parallel to and overlaps the radius R of the lens 300. In one implementation of this embodiment, a plurality of dual band concentric feeds 41 and/or 43 are arranged around at least a portion of the outer surface of the lens 300. In this latter embodiment, extensions of the plurality of shared axes 400 of the plurality of dual band concentric antenna feeds 41 and/or 43 intersect at the center of the lens 300.

A portion 122 of the dielectric material 121 extends beyond the aperture plane ($X_{out}$, $Y_{out}$) (FIGS. 1 and 2A) of the dual band concentric feeds 41 and 43. The portion 122 is also referred to herein as a dielectric tip 122.

FIG. 11 shows a cross-sectional side view of the dual band concentric feed 41 (FIGS. 9A-9D) with plug 169 arranged with the lens 300. The dual band concentric antenna feed 41 is designed for peak gain, crossover gain, and axial ratio for a second band. The antenna beam of FIG. 11 has a pattern angle of $\alpha$.

Figure 13:
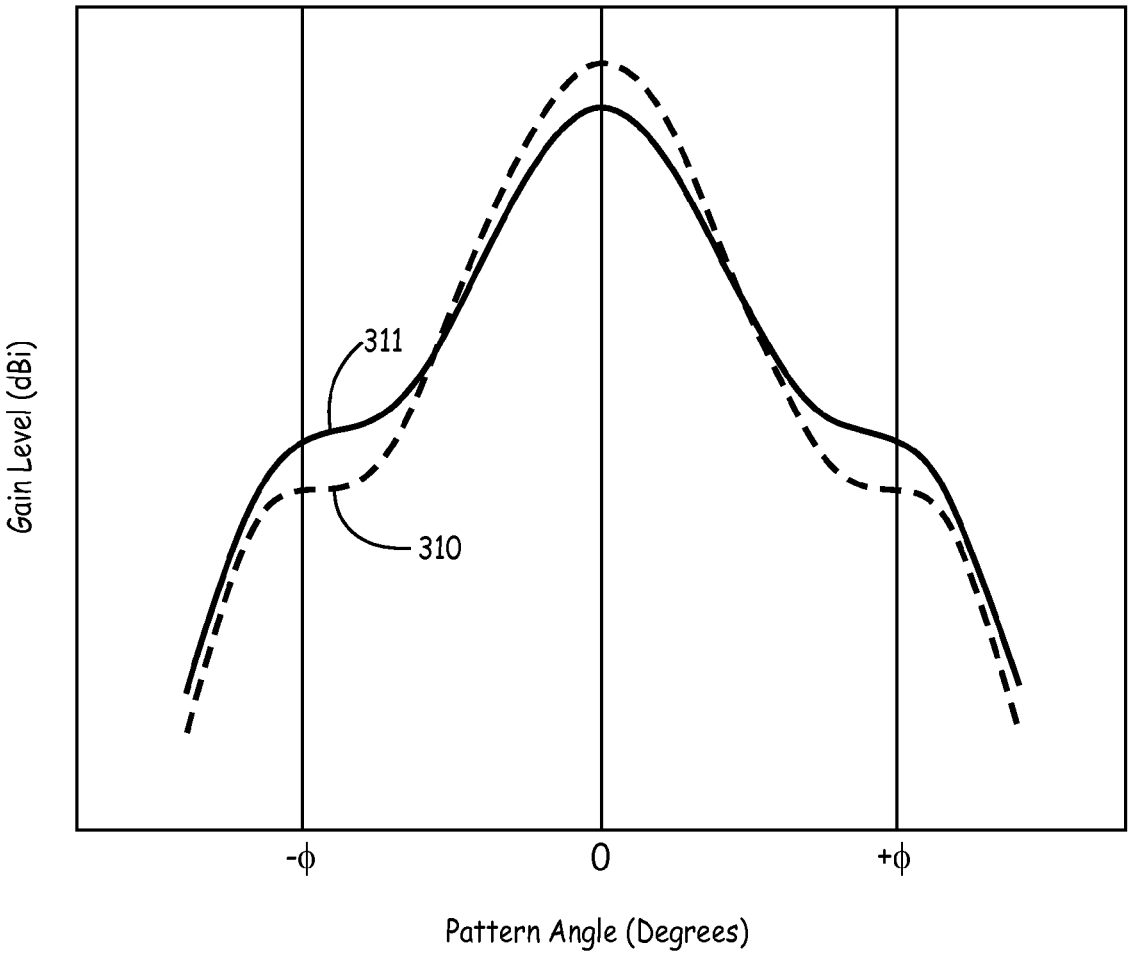
FIG. 13 shows plots of the second-band antenna gain pattern for the dual band concentric feed and lens of FIG. 11 and FIG. 12.
Figure 14:
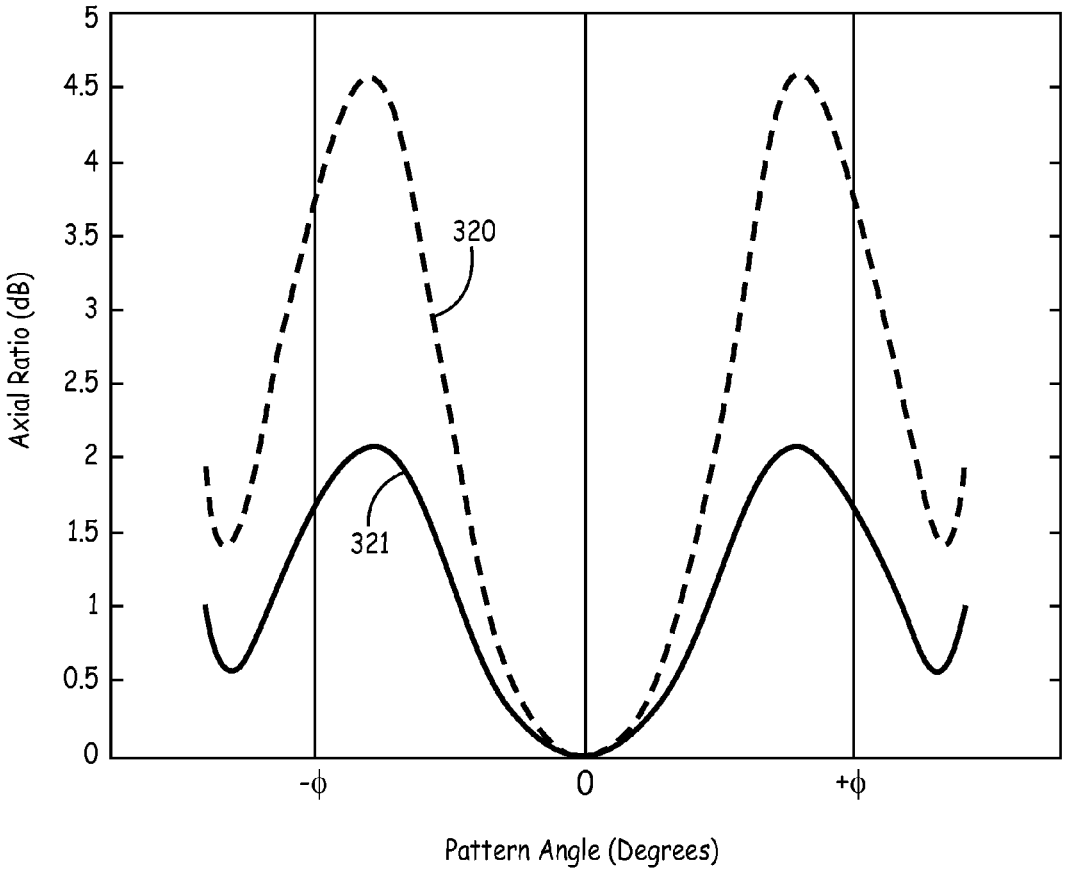
FIG. 14 shows plots of the second-band axial ratio for the dual band concentric feed and lens of FIG. 11 and FIG. 12.

In a switched beam antenna system, multiple feeds are available so that the feed producing the highest antenna gain in an intended direction can be selected. The pattern angle where two adjacent antenna beams intersect is a crossover angle since it is the best angular location for the beam pointing algorithm to "crossover" from one antenna beam (or feed) to the next. The crossover gain is the gain value at these crossover angles. As shown in FIGS. 13 and 14, exemplary crossover angles are $\pm\phi$. In this case, the adjacent beams (not shown) from a plurality of dual band concentric feeds arranged around at least a portion of the outer surface of the lens 300 would start with the same crossover gain. In such an embodiment, the N beam patterns, taken as a group, cover an angular range of ±Nϕ.

FIG. 12 shows a cross-sectional side view of the dual band concentric feed 43 (FIGS. 10A-10D) with plug 170 arranged with the lens 300. The dual band concentric antenna feed 43 is designed for peak gain, crossover gain, and axial ratio for a second band. The antenna beam of FIG. 12 also has a pattern angle of α.

FIG. 13 shows plots 310 and 311 of the second frequency band antenna gain pattern for the dual band concentric feed and lens of FIG. 11 and FIG. 12, respectively. The solid curve of plot 311, which is associated with FIG. 12, has a higher crossover gain at +ϕ and −ϕ than the dashed curve of plot 310, which is associated with FIG. 11. The solid curve of plot 311 has a lower peak gain at pattern angle of zero degrees (0°) than the dashed curve of plot 310.

FIG. 14 shows plots 320 and 321 of the axial ratio for the dual band concentric feeds and lens of FIG. 11 and FIG. 12, respectively, when excited through an ideal circular polarizer. The plots 320 and 321 are for the second frequency band (e.g., at frequencies greater than $f_3$ as shown in FIG. 4). The gain level of the pattern shoulders (at pattern angles +ϕ and −ϕ) and the peak gain (at pattern angle 0°) are controlled by the location of the filter 150 with reference to the plug (e.g., plug 169 or 170). Additionally, the dielectric loading provided by the plug (e.g., plug 169 or plug 170) affects the wave propagation constant of the coaxial waveguide (e.g., the coaxial waveguide 110 in of the dual band concentric antenna 41 shown in FIG. 1, or the coaxial waveguide 110 in of the dual band concentric antenna 43 shown in FIG. 12) in the region occupied by the plug. Thus, controlling the length of the plug is another method for controlling the electrical location of the filter 150 within the coaxial waveguide in the dual band concentric antenna feed in the second frequency band.

In the second frequency band, the electromagnetic wave propagates through the circular waveguide 120 and radiates from the dielectric tip 122. Some band 2 energy in the vicinity of the tip 122 enters the coaxial waveguide 110 near the end of the plug and propagates toward the filter 150 where the band 2 energy is completely reflected due to the excellent band 2 rejection properties of the filter 150 as shown in FIG. 4. The reflected band 2 energy propagates through the coaxial waveguide 110 to the end of the feed (output aperture 180 shown in FIGS. 1 and 2A) where it recombines with the original propagated band 2 signal, is focused by the lens 300, and radiates into free space. The phase delay caused by the propagation and reflection of the band 2 wave in the coaxial waveguide 110 forward of the filter 150 (e.g., between the filter 150 and the output aperture 180) is used to optimize the antenna gain pattern for band 2 frequencies.

FIG. 14 shows that the band 2 axial ratio of an antenna that is fed by a dual band concentric antenna feed 41 or 43 (FIG. 11 or 12) coupled to the lens 300 is significantly reduced with proper selection of the filter position and plug length. FIG. 14 also shows that the axial ratio of an antenna that is fed by a dual band concentric antenna feed 41 or 43 (FIG. 11 or 12) coupled to the lens 300 is significantly reduced with proper selection of the filter position and plug length.

EXAMPLE EMBODIMENTS

Example 1 includes a dual band concentric antenna feed comprising: an outer conductive tube having an inner surface; an inner conductive tube having an outer surface, the inner conductive tube positioned inside the outer conductive tube and coaxially aligned to a shared axis that extends a length of the outer conductive tube and the inner conductive tube, wherein a coaxial waveguide formed in a space between the inner surface of the outer conductive tube and the outer surface of the inner conductive tube supports a first frequency band, and wherein a circular waveguide formed within an inner surface of the inner conductive tube supports a second frequency band; at least one transformer in the coaxial waveguide; a filter in the coaxial waveguide, the filter being offset from the at least one transformer, wherein an impedance locus associated with the filter is high-frequency capacitive within the first frequency band and low-frequency inductive within the first frequency band; and a plug in the coaxial waveguide, the plug being offset from the at least one transformer and the filter and positioned near an aperture end of the concentric antenna feed.

Example 2 includes the dual band concentric antenna feed of Example 1, further comprising a dielectric material filling the inner conductive tube.

Example 3 includes the dual band concentric antenna feed of Example 2, wherein a portion of the dielectric material filling the inner conductive tube extends beyond the aperture plane to form a dielectric tip.

Example 4 includes the dual band concentric antenna feed of any of Examples 1-3, wherein the at least one transformer in the coaxial waveguide comprises: a first transformer in series with the plug; and a second transformer in series with the first transformer and the plug, wherein an input impedance looking into an equivalent circuit of the first transformer, the second transformer, the plug, and a shunt coaxial aperture impedance is low-frequency capacitive in the first frequency band and is high-frequency inductive in the first frequency band.

Example 5 includes the dual band concentric antenna feed of Example 4, wherein the first transformer is positioned between the plug and the second transformer, and wherein the second transformer is positioned between the filter and the first transformer.

Example 6 includes the dual band concentric antenna feed of Example 5, wherein the plug has a length of 90 electrical degrees, and wherein the shunt coaxial aperture impedance is matched across the first frequency band.

Example 7 includes the dual band concentric antenna feed of any of Examples 4-6, wherein the first transformer is formed from a dielectric ring and the second transformer is formed in the coaxial waveguide as a protrusion of the outer surface of the inner conductive tube.

Example 8 includes the dual band concentric antenna feed of any of Examples 4-7, wherein the first transformer is formed in the coaxial waveguide as a first protrusion on the outer surface of the inner conductive tube and the second transformer is formed in the coaxial waveguide as a second protrusion on the outer surface of the inner conductive tube, wherein a first gap is between the first protrusion and the inner surface of the outer conductive tube, and wherein a second gap is between the second protrusion and the inner surface of the outer conductive tube.

Example 9 includes the dual band concentric antenna feed of any of Examples 4-8, wherein the first transformer is formed from a dielectric ring and the second transformer is formed from a dielectric ring.

Example 10 includes the dual band concentric antenna feed of any of Examples 1-9, wherein the plug has a length of 90 electrical degrees, and wherein a shunt coaxial aperture impedance is matched across the first frequency band.

Example 11 includes the dual band concentric antenna feed of any of Examples 1-10, wherein the at least one transformer in the coaxial waveguide comprises: a transformer, wherein the filter is positioned between the transformer and the plug, and wherein a length of the plug is optimized to increase a crossover gain in the second frequency band and decrease an axial ratio in the second frequency band.

Example 12 includes the dual band concentric antenna feed of Example 11, wherein the plug has a length of 90 electrical degrees in the first frequency band, wherein the input return loss across the first frequency band is less than −20 dB.

Example 13 includes the dual band concentric antenna feed of any of Examples 11-12, wherein the plug has a length of 40 electrical degrees in the first frequency band.

Example 14 includes an antenna system comprising: a dual band concentric antenna feed including: an outer conductive tube having an inner surface; an inner conductive tube having an outer surface, the inner conductive tube positioned inside the outer conductive tube and coaxially aligned to a shared axis that extends a length of the outer conductive tube and the inner conductive tube, wherein a coaxial waveguide formed in a space between the inner surface of the outer conductive tube and the outer surface of the inner conductive tube supports a first frequency band, and wherein a circular waveguide formed within an inner surface of the inner conductive tube supports a second frequency band; at least one transformer in the coaxial waveguide; a filter in the coaxial waveguide, the filter being offset from the at least one transformer, wherein an impedance locus associated with the filter is high-frequency capacitive within the first frequency band and low-frequency inductive within the first frequency band; and a plug in the coaxial waveguide, the plug being offset from the at least one transformer and the filter, the plug filling a space between the outer surface of the inner conductive tube and the inner surface of the outer conductive tube at an aperture plane, the antenna system further comprising: a lens having a radius, wherein a distance between the aperture plane and the lens is selected to provide a desired antenna beam pattern, and wherein an extension of the shared axis of the dual band concentric feed is parallel to and overlaps the radius of the lens.

Example 15 includes the antenna system of Example 14, further comprising a dielectric material filling the inner conductive tube.

Example 16 includes the antenna system of any of Examples 14-15, wherein the at least one transformer in the coaxial waveguide comprises: a first transformer in series with the plug; and a second transformer in series with the first transform and the plug, wherein an input impedance looking into an equivalent circuit of the first transformer, the second transformer, the plug, and a shunt coaxial aperture impedance is low-frequency capacitive in the first frequency band and is high-frequency inductive in the first frequency band.

Example 17 includes the antenna system of Example 16, wherein the first transformer is formed from a dielectric ring and the second transformer is formed as a protrusion in the coaxial waveguide.

Example 18 includes the antenna system of any of Examples 16-17, wherein the first transformer is formed from a protrusion in the coaxial waveguide and the second transformer is formed as a protrusion in the coaxial waveguide, wherein a first gap is between the first transformer and the inner surface of the outer conductive tube, and wherein a second gap is between the second transformer and the inner surface of the outer conductive tube.

Example 19 includes the antenna system of any of Examples 14-18, wherein the at least one transformer in the coaxial waveguide comprises: a transformer, wherein the filter is positioned between the transformer and the plug, and wherein a length of the plug is optimized to increase a crossover gain in the second frequency band and decrease an axial ratio in the second frequency band.

Example 20 includes a dual band concentric antenna feed comprising: an outer conductive tube having an inner surface; an inner conductive tube having an outer surface, the inner conductive tube positioned inside the outer conductive tube and coaxially aligned to a shared axis that extends a length of the outer conductive tube and the inner conductive tube, wherein a coaxial waveguide formed in a space between the inner surface of the outer conductive tube and the outer surface of the inner conductive tube supports a first frequency band, and wherein a circular waveguide formed within an inner surface of the inner conductive tube supports a second frequency band; a first transformer in the coaxial waveguide; a second transformer in the coaxial waveguide; a filter in the coaxial waveguide, wherein an impedance locus associated with the filter is high-frequency capacitive within the first frequency band and low-frequency inductive within the first frequency band; and a plug in the coaxial waveguide, the plug filling a space between the outer surface of the inner conductive tube and the inner surface of the outer conductive tube at an aperture plane, the plug having an electrical length of 90 degrees in the first frequency band, wherein the first transformer is positioned between the plug and the second transformer, the second transformer is positioned between the first transformer and the filter, and wherein an input impedance looking into an equivalent circuit of the first transformer, the second transformer, the plug, and a shunt coaxial aperture impedance is low-frequency capacitive in the first frequency band and is high-frequency inductive in the first frequency band.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A dual band concentric antenna feed comprising:

an outer conductive tube having an inner surface;

an inner conductive tube having an outer surface, the inner conductive tube positioned inside the outer conductive tube and coaxially aligned to a shared axis that extends a length of the outer conductive tube and the inner conductive tube, wherein a coaxial waveguide formed in a space between the inner surface of the outer conductive tube and the outer surface of the inner conductive tube supports a first frequency band, and wherein a circular waveguide formed within an inner surface of the inner conductive tube supports a second frequency band;

at least one transformer in the coaxial waveguide;

a filter in the coaxial waveguide, the filter being offset from the at least one transformer, the filter designed so that, when the filter is evaluated independently over a first frequency band, with respect to an input port of the filter and with respect an output port of the filter, the filter is inductive at frequency $f_1$, capacitive at frequency $f_2$, and is well matched near frequency $(f_1+f_2)/2$; and a dielectric plug in the coaxial waveguide, the plug being offset from the at least one transformer and the filter and positioned near an aperture end of the concentric antenna feed.

2. The dual band concentric antenna feed of claim 1, further comprising a dielectric material filling the inner conductive tube.

3. The dual band concentric antenna feed of claim 2, wherein a portion of the dielectric material filling the inner conductive tube extends beyond the aperture plane to form a dielectric tip.

4. The dual band concentric antenna feed of claim 1, wherein the at least one transformer in the coaxial waveguide comprises:

a first transformer in series with the plug; and a second transformer in series with the first transformer and the plug, wherein an input impedance looking into an equivalent circuit of the first transformer, the second transformer, the plug, and a shunt coaxial aperture impedance is low-frequency capacitive in the first frequency band and is high-frequency inductive in the first frequency band.

5. The dual band concentric antenna feed of claim 4, wherein the first transformer is positioned between the plug and the second transformer, and wherein the second transformer is positioned between the filter and the first transformer.

6. The dual band concentric antenna feed of claim 5, wherein the plug has a length of a quarter of a guide wavelength at $(f_1+f_2)/2$, and wherein the shunt coaxial aperture impedance is matched across the first frequency band.

7. The dual band concentric antenna feed of claim 4, wherein the first transformer is formed from a dielectric ring and the second transformer is formed in the coaxial waveguide as a protrusion of the outer surface of the inner conductive tube.

8. The dual band concentric antenna feed of claim 4, wherein the first transformer is formed in the coaxial waveguide as a first protrusion on the outer surface of the inner conductive tube and the second transformer is formed in the coaxial waveguide as a second protrusion on the outer surface of the inner conductive tube, wherein a first gap is between the first protrusion and the inner surface of the outer conductive tube, and wherein a second gap is between the second protrusion and the inner surface of the outer conductive tube.

9. The dual band concentric antenna feed of claim 4, wherein the first transformer is formed from a dielectric ring and the second transformer is formed from a dielectric ring.

10. The dual band concentric antenna feed of claim 1, wherein the plug has a length of a quarter of a guide wavelength at $(f_1+f_2)/2$, and wherein a shunt coaxial aperture impedance is matched across the first frequency band.

11. The dual band concentric antenna feed of claim 1, wherein the at least one transformer in the coaxial waveguide comprises:

a transformer, wherein the filter is positioned between the transformer and the plug, and wherein a length of the plug is optimized to increase a crossover gain in the second frequency band and decrease an axial ratio in the second frequency band.

12. The dual band concentric antenna feed of claim 11, wherein the plug has a length of a quarter of a guide wavelength at $(f_1+f_2)/2$ in the first frequency band, wherein the input return loss across the first frequency band is less than −20 dB.

13. The dual band concentric antenna feed of claim 11, wherein the plug has a length of 40 electrical degrees in the first frequency band.

14. An antenna system comprising:

at least one dual band concentric antenna feed including:

an outer conductive tube having an inner surface;

an inner conductive tube having an outer surface, the inner conductive tube positioned inside the outer conductive tube and coaxially aligned to a shared axis that extends a length of the outer conductive tube and the inner conductive tube, wherein a coaxial waveguide formed in a space between the inner surface of the outer conductive tube and the outer surface of the inner conductive tube supports a first frequency band, and wherein a circular waveguide formed within an inner surface of the inner conductive tube supports a second frequency band;

at least one transformer in the coaxial waveguide;

a filter in the coaxial waveguide, the filter being offset from the at least one transformer, wherein an impedance locus associated with the filter is high-frequency capacitive within the first frequency band and low-frequency inductive within the first frequency band; and a dielectric plug in the coaxial waveguide, the plug being offset from the at least one transformer and the filter, the plug filling a space between the outer surface of the inner conductive tube and the inner surface of the outer conductive tube at an aperture plane, the antenna system further comprising:

a lens having a radius, wherein at least one distance between the respective at least one aperture plane of the at least one dual band concentric antenna feed and the lens is selected to provide a desired antenna beam pattern, and wherein an extension of the shared axis of the dual band concentric feed is parallel to and overlaps the radius of the lens.

15. The antenna system of claim 14, further comprising a dielectric material filling the inner conductive tube.

16. The antenna system of claim 14, wherein the at least one transformer in the coaxial waveguide comprises:

a first transformer in series with the plug; and a second transformer in series with the first transform and the plug, wherein an input impedance looking into an equivalent circuit of the first transformer, the second transformer, the plug, and a shunt coaxial aperture impedance is low-frequency capacitive in the first frequency band and is high-frequency inductive in the first frequency band.

17. The antenna system of claim 16, wherein the first transformer is formed from a dielectric ring and the second transformer is formed as a protrusion in the coaxial waveguide.

18. The antenna system of claim 16, wherein the first transformer is formed from a protrusion in the coaxial waveguide and the second transformer is formed as a protrusion in the coaxial waveguide, wherein a first gap is between the first transformer and the inner surface of the outer conductive tube, and wherein a second gap is between the second transformer and the inner surface of the outer conductive tube.

19. The antenna system of claim 14, wherein the at least one transformer in the coaxial waveguide comprises:

a transformer, wherein the filter is positioned between the transformer and the plug, and wherein a length of the plug is optimized to increase a crossover gain in the second frequency band and decrease an axial ratio in the second frequency band.

20. A dual band concentric antenna feed comprising:

an outer conductive tube having an inner surface;

an inner conductive tube having an outer surface, the inner conductive tube positioned inside the outer conductive tube and coaxially aligned to a shared axis that extends a length of the outer conductive tube and the inner conductive tube, wherein a coaxial waveguide formed in a space between the inner surface of the outer conductive tube and the outer surface of the inner conductive tube supports a first frequency band, and wherein a circular waveguide formed within an inner surface of the inner conductive tube supports a second frequency band;

a first transformer in the coaxial waveguide;

a second transformer in the coaxial waveguide;

a filter in the coaxial waveguide, the filter designed so that, when the filter is evaluated independently over a first frequency band, with respect to an input port of the filter and with respect an output port of the filter, the filter is inductive at frequency $f_1$, capacitive at frequency $f_2$, and is well matched near frequency $(f_1+f_2)/2$; and a dielectric plug in the coaxial waveguide, the plug filling a space between the outer surface of the inner conductive tube and the inner surface of the outer conductive tube at an aperture plane, the plug having a length of a quarter of a guide wavelength at $(f_1+f_2)/2$ in the first frequency band, wherein the first transformer is positioned between the plug and the second transformer, the second transformer is positioned between the first transformer and the filter, and wherein an input impedance looking into an equivalent circuit of the first transformer, the second transformer, the plug, and a shunt coaxial aperture impedance is low-frequency capacitive in the first frequency band and is high-frequency inductive in the first frequency band.

* * * * *